US005761883A

United States Patent [19]

Pruett et al.

[11] Patent Number: 5,761,883

[45] Date of Patent: Jun. 9, 1998

[54] COOKIE TRAY LOADING MACHINE

[75] Inventors: Daniel W. Pruett, Athens; Charles T. Haley, Bogart; Timothy Philipp, Watkinsville, all of Ga.

[73] Assignee: Food Machinery Sales, Inc., Athens, Ga.

[21] Appl. No.: 563,667

[22] Filed: Nov. 28, 1995

[51] Int. Cl.[6] ..... B65B 35/30

[52] U.S. Cl. ..... 53/448; 53/246; 53/247; 53/251; 53/534; 53/543; 53/475; 53/498; 53/499

[58] Field of Search ..... 53/246, 247, 251, 53/534, 543, 448, 475, 493, 495, 498, 499; 198/367, 442, 436, 437, 601, 890, 890.1, 689.1, 459.8, 460.1

[56] References Cited

U.S. PATENT DOCUMENTS

| | | | |
|---|---|---|---|
| 2,928,520 | 3/1960 | Boehler | 198/442 |
| 3,008,564 | 11/1961 | Lakso | 198/437 X |
| 3,290,859 | 12/1966 | Talbot . | |
| 4,016,788 | 4/1977 | Hardy | 198/436 X |
| 4,507,908 | 4/1985 | Seragnoli | 53/498 |
| 4,514,963 | 5/1985 | Gruno | 53/493 |
| 4,590,743 | 5/1986 | Hardage . | |
| 4,662,152 | 5/1987 | Simelunas et al. | 53/246 |
| 4,712,356 | 12/1987 | Hardage et al. . | |
| 4,720,006 | 1/1988 | Lenherr | 198/689.1 X |
| 4,736,570 | 4/1988 | Hardage et al. . | |
| 4,744,201 | 5/1988 | Total et al. | 53/493 X |
| 4,768,328 | 9/1988 | Mims . | |
| 4,771,876 | 9/1988 | Bandixen | 198/442 X |
| 4,815,581 | 3/1989 | Deutschlander | 198/689.1 X |
| 4,823,930 | 4/1989 | Low | 198/442 X |
| 4,902,194 | 2/1990 | Lane | 198/689.1 X |
| 4,921,398 | 5/1990 | Fluck | 53/542 X |
| 4,945,825 | 8/1990 | Florindez | 53/534 X |
| 5,038,915 | 8/1991 | Delsanto | 198/460.1 X |
| 5,070,995 | 12/1991 | Schaffer et al. | 198/460.1 |
| 5,082,103 | 1/1992 | Ross et al. | 198/460.1 |
| 5,095,684 | 3/1992 | Walker et al. . | |
| 5,114,307 | 5/1992 | Meli et al. | 198/689.1 X |
| 5,193,329 | 3/1993 | Loffredo et al. | 53/251 X |
| 5,209,339 | 5/1993 | Antonissen | 198/436 |
| 5,303,811 | 4/1994 | Haley . | |
| 5,423,409 | 6/1995 | Wipf | 198/437 X |
| 5,582,284 | 12/1996 | Calladine et al. | 198/442 X |

FOREIGN PATENT DOCUMENTS

| | | | |
|---|---|---|---|
| 317198 | 5/1989 | European Pat. Off. . | |
| 619229 | 10/1994 | European Pat. Off. | 198/890 |
| 2277073 | 10/1994 | United Kingdom | 198/442 |

*Primary Examiner*—Daniel Moon
*Attorney, Agent, or Firm*—Isaf, Vaughan & Kerr; Charles H. Fails

[57] ABSTRACT

A cookie tray loading machine (5) constructed and arranged to divert a single file lane of cookies (12) moved along an infeed conveyor belt (9) into a plurality of separate and generally parallel lanes (34) of cookies, which are formed as rows (44) of cookies on a plurality of alignment belt assemblies (36) and spaced apart from each preceding row of cookies, each row of cookies being placed onto a tray loading conveyor belt (46) and moved toward a tray loading station (60) for placement directly into a packaging tray (62), is disclosed. The loading machine includes a sweep arm diverter assembly (20) having a sweep arm diverter (21) directly driven by a sweep arm servomotor (23), a first lane alignment arm assembly (26) and a second and opposed lane alignment arm assembly (30) for aligning the cookies into the separate lanes of cookies, and an alignment belt assembly (36) for each lane of cookies. Each alignment belt assembly includes an alignment belt cookie sensor (37), an alignment belt (38), and an alignment belt servomotor (40) for directly driving each alignment belt separately from the others. Each row of cookies formed on the cookie tray loading machine is placed by the tray loading conveyor belt directly into the packaging tray, the packaging tray being positioned on a packaging tray indexing conveyor (65) at the tray loading station. Thereafter, in response to the receipt of a row of cookies, the tray indexing conveyor carries the packaging tray a distance sufficient to allow for the next row of cookies to be placed directly into the packaging tray.

32 Claims, 13 Drawing Sheets

COOKIE TRAY LOADING MACHINE

FIELD OF THE INVENTION

This invention relates in general to food packaging machinery. More particularly, this invention relates to an improved cookie tray loading machine for forming a single file lane of cookies into spaced rows of cookies, and loading the rows of cookies directly into cookie trays.

BACKGROUND OF THE INVENTION

The production of cookies and similar foodstuffs involves the baking, handling, and packaging of large numbers of similarly shaped items. Examples of these items are cookies and crackers or the like, all of which are relatively uniform in size and shape and thus relatively easy to process and package. However, a new type of cookie is becoming popular in which a small, baked cookie-size cake is completely covered or enrobed with several substances, to include chocolate, as the cookie is built up over the cake.

This type of cookie includes a baked cake-like cookie center, around which layers of chocolate are enrobed so that a chocolate-covered cake type of cookie is created. These cookie cakes are similar to hard cookies in some aspects, however these cookies will have more variations in size and shape from cookie to cookie due to the manner in which the cookies are made, and in particular due to the manner in which chocolate is built up or layered on the exterior surface of the cookie. These variations in size and shape tend to make these cookies more difficult to handle. Also, the fact the cookies are chocolate-covered makes the cookies more prone to becoming sticky or tacky, so that the cookies can adhere not only to each other but to the cookie processing and packaging machinery as well.

The cookies move along a cookie production machine until they are completed, whereupon the cookies are typically moved laterally away from the cookie production machine in single file fashion and toward the tray loading and packaging machines. This single file lane of cookies must then be formed into a number of rows of cookies compatible with the numbers and rows of cavities or cells of the cookie tray into which they are loaded. Due to the large volume of cookies being produced in modern bakeries, a reliable, simple, and efficient method and apparatus is needed for forming the separate lane of cookies into spaced rows of cookies, whereupon the spaced rows of cookies are loaded directly into the cells of the cookie tray in order to minimize handling of the cookies.

Cookie tray loading machines, as such, are known in the art. Among the prior art devices used for loading cookies and the like are devices used for forming a plurality of separate lanes of cookies into rows by using gates or a series of spaced fingers which come into physical contact with the cookie, such as that disclosed in U.S. Pat. No. 5,303,811 issued to Haley on Apr. 19, 1994. Although this method of aligning cookies into rows and spacing the rows of cookies apart from each other works well with most cookies and crackers, this apparatus is not intended for use with chocolate-covered cake-type cookies. In these devices the gates or fingers may damage the cookies, as well as having layers of chocolate or other product residue deposited thereon from the cookies having come into contact with the gate. This may result in the failure to properly form the cookies into a number of like rows due to cookies sticking to the gate, as well as damaging the product.

Another feature of the prior art cookie tray loaders is that they accumulate cookies and place them in an intermediate chamber or tray, and then transfer the accumulated cookies from the intermediate chamber into the cookie tray used for packaging the cookies. Examples of these types of cookie tray loading machines are disclosed in U.S. Pat. Nos. 4,712,356 to Hardage, et al., issued Dec. 15, 1987; 4,736,570 to Hardage, et al. issued Apr. 12, 1988; and 5,095,684 issued to Walker, et al. on Mar. 17, 1992. In each of these cookie loaders, a plurality of cookies are moved along a series of conveyor belts in single file fashion, or in a plurality of generally aligned lanes, to then be accumulated in an intermediate cell, tray, or chamber, whereupon the collected cookies or crackers are transferred into the cookie trays.

The cookie loading system disclosed in Hardage, et al., U.S. Pat. No. 4,736,570, differs to some extent from the other disclosed cookie tray loaders in that a single file lane of cookies is diverted to form two generally parallel lanes of cookies while being moved along a series of conveyor belts. Each lane of cookies is moved toward an intermediate cookie tray or chamber for accumulating the cookies from which the cookies are then transferred to a cookie packaging tray. This patent to Hardage, et al., however, does not disclose a method nor a structure for aligning the cookies within the two lanes of cookies into generally laterally aligned spaced rows of cookies extending across the lanes of cookies, which are then moved toward and loaded directly into a cookie tray, and in which the cookie tray.

Chocolate-covered or enrobed cake-type cookies cannot be readily accumulated in an intermediate tray or chamber as the cookies will, of necessity, have to be pressed one against the other as they are moved in line to form an on-edge stack, known as a slug in the industry, within the accumulating chamber. Prior to inverting or emptying the accumulating chamber, these chocolate covered cake-type cookies will likely adhere to or fuse to one another in the accumulating chamber, with the result that the cookies will not be able to fall into their individual slots in the cookie tray thus necessitating manual cookie handling which, as discussed above, is undesirable.

Another problem encountered with chocolate-covered cake-type cookies is that chain conveyers having a series of upwardly extending spaced timing pins, forming flights therebetween, for physically holding the cookies may be used for moving cookies along the conveyor line. However, chain conveyors cannot be readily used with this type of cookie because chocolate will either drip off of the cookie as it hardens, or will be stripped off of the cookie by the conveyor system thus fouling the conveyor system with accumulated chocolate and pieces of cookie, as well as damaging the product. Not only will this result in lower production rates, it may also result in increased operating costs due to the need to continually clean and maintain the equipment as it gets coated with the sticky remnants of cookies. By the same token, the production of the chocolate-covered cake-type cookies is also not well suited to manual cookie handling in that the chocolate-covered exterior of the cookie will become soft and gooey when being handled by production line workers. Thus, the need arises to minimize the number of times chocolate covered cake type cookies are handled while being processed for packaging.

Thus, what is needed, but seemingly not available in the art, is a cookie tray loading machine which minimizes the handling of chocolate-covered cake-type cookies while providing a cost efficient and swift method of loading cookies as they come off the cookie production line. By minimizing the handling of cookies, both damage to the cookies is minimized as well as minimizing the time and effort needed to clean the cookie tray packaging line.

What is also needed, and seemingly unavailable in the art, is a cookie tray loading machine which receives a single-file lane of cookies from a feed conveyor belt, diverts the cookies into a plurality of generally parallel lanes, and forms the cookies on each of the lanes of cookies into generally laterally aligned rows of cookies, each of the rows being spaced apart from the next adjacent row, and then loading the rows of cookies directly into a cookie tray. Moreover, what is needed is a method and apparatus for performing this function automatically without the need for manual intervention in the cookie tray loading process.

None of the prior art known to inventors discloses or illustrates a cookie tray loading machine which minimizes the physical handling of the product, nor which diverts a single-file lane of cookies into a series of generally aligned and spaced rows of cookies with a minimal amount of handling, and then loads these cookies directly into a cookie tray without using an intermediate chamber or accumulating tray. Thus, and as discussed above, the need exists for improved yet simple cookie tray loading machine which can automatically process a high volume flow of cookies fed in single-file fashion into the cookie tray loading machine, divert the cookies into a series of generally parallel lanes, form the cookies into spaced rows of cookies, and then load each row of cookies directly into a cookie tray while also indexing the cookie tray in response to loading each row of cookies therein.

SUMMARY OF THE INVENTION

Briefly described, the present invention provides an improved cookie tray loading method and apparatus which overcomes some of the design deficiencies of other cookie sorting and tray loading devices known in the art by providing both an apparatus and an automated, computer controlled method for loading cookies and/or similar objects directly into a packaging tray.

In the computer controlled method of this invention, the computer waits for a first notification that a cookie is moving along an infeed conveyor line, the leading edge of each cookie being detected as it moves along the infeed conveyor line past a detecting station which generates the first notification to the computer. Thereafter, the computer waits for a second notification that the trailing edge of the cookie has been detected as it is moved along the infeed conveyor belt to a desired position, whereupon a corresponding object is assigned to each cookie, the object representing the motion of the cookie and generating a third notification to the computer that the cookie is in its desired location to be diverted.

Thereafter, in response to the third notification, the cookie is diverted toward one of a plurality of generally parallel alignment or aligning belts, the computer then awaiting a fourth notification that one of each of the cookies has arrived on each aligning belt. Next, the motion of each aligning belt is adjusted with respect to the other aligning belts to form the cookies situated thereon into a first generally aligned row of cookies having a predetermined pattern, and moving the row of cookies together onto a tray loading conveyor in response thereto.

Thereafter, with the novel computer-controlled method disclosed herein, the computer awaits a fifth notification that the first row of cookies has been detected as it is moved along the tray loading conveyor and delivered to a product container, i.e., a cookie tray, whereupon the cookie tray is indexed to receive the next row of cookies in response to the fifth notification. Thus, a first row of cookies is placed directly into the cookie tray without the use of any kind of intermediate accumulating chamber or tray, and without being unduly handled. Thereafter, successive rows of cookies are formed and loaded in the cookie tray.

The computer-controlled method of this invention provides that the motion of each aligning belt will be adjusted with respect to the other alignment belts as each subsequent and successive row of cookies is formed thereon, so that the rows of cookies are spaced apart from one another in order to allow adequate time to index the packaging tray upward or downward, or forward or backward, for loading the rows of cookies directly into the tray, and from tray-to-tray. Thus, and unlike conventional computer controlled systems which constantly poll the system for data, this novel method of controlling a tray loading machine waits for cookies to be detected, thus allowing the process computer to operate more efficiently and perform other tasks while awaiting cookies or other articles of product.

Another novel aspect of this invention is that rather than using gates or fingers to physically retain and align the cookies, a series of parallel aligning belts is used, each one of the aligning belts being separately powered and controlled so that the cookies are transferred onto the aligning belts without otherwise being physically handled, and aligned thereon into a row of cookies. The aligning belts also phase each row of cookies into spaced groups or rows of cookies, which are then transferred onto a tray loading conveyor and loaded directly from the tray loading conveyor into the cookie trays.

Thus, the apparatus disclosed herein for practicing this novel control method includes a cookie tray loading machine having a framework with a longitudinal centerline, an infeed conveyor belt supported on the framework for moving cookies in single file fashion thereon, and an infeed alignment arm for aligning the cookies along the centerline of the infeed conveyor belt. The then aligned cookies are passed toward a sweep arm diverter which diverts the single-file lane of cookies into a plurality of separate and generally parallel lanes of cookies. A detector is positioned upstream of the sweep arm diverter and above the centerline of the infeed conveyor belt for detecting the presence of cookies moving toward the sweep arm, the sweep arm being constructed and arranged to be moved in response to the detection of the cookies.

A plurality of aligning belt assemblies are supported on the framework downstream of the sweep arm for forming the now diverted and separated lanes of cookies into a plurality of generally aligned rows of cookies formed laterally across the separate lanes of cookies, the aligning belt assemblies being constructed and arranged so that the rows of cookies are generally and equally spaced apart from one another, and passed together to the tray loading conveyor for direct loading into a cookie tray.

Thus, the use of this new cookie tray packaging machine automates and greatly simplifies the handling and loading of chocolate-covered cake-type cookies, and permits direct loading of cookies into cookie trays. However, this novel cookie tray packaging machine, and the method of its use, are equally well suited for use with conventional cookies and crackers, or the like, and other similar articles of product in which articles of product are diverted into a plurality of separate but generally parallel lanes of product, the articles of product then being moved into generally aligned rows across the lanes of objects, and spaced apart from one another by a plurality of aligning belt assemblies supported on the cookie tray loading machine for loading directly into packaging trays.

Thus, it is an object of this invention to provide an improved cookie tray loading machine which minimizes handling of the articles of product to be packaged.

An additional object of the invention is to provide an improved cookie tray loading machine which provides for the direct loading of articles of product into product containers or trays.

Yet another object of the present invention is to provide an improved cookie tray loading machine which will gently and swiftly divert a single file lane of articles of product into a plurality of separate lanes of product for further processing and packaging.

Still another object of the present invention to provide an improved cookie tray loading machine which will operate reliably at high production rates and which minimizes the amount of damage to the articles of product to be packaged.

It is also an object of the invention to provide an improved cookie tray loading machine which fully automates the cookie tray loading process.

Another object of the present invention is to provide an improved cookie tray loading machine which will form a plurality of articles of product into generally aligned rows of articles of product spaced apart from one another without using a mechanical gate or other physical means to form the cookies into rows.

An additional object of this invention is to provide an improved cookie tray loading machine which will directly load a single-file infeed lane of articles of product into a three-cell tray.

Still another object of the present invention is to provide an improved cookie tray loading machine which will create a desired gap between rows of articles of product in order to provide sufficient time for the product to settle into a packaging tray, and for the packaging tray to be indexed for receiving the next row of articles of product.

Thus, these and other objects, features, and advantages of the invention will become apparent upon reading the specification when taken in conjunction with the accompanying drawings, wherein like characters of reference designate corresponding parts throughout the several views.

DETAILED DESCRIPTION

Figure 1:
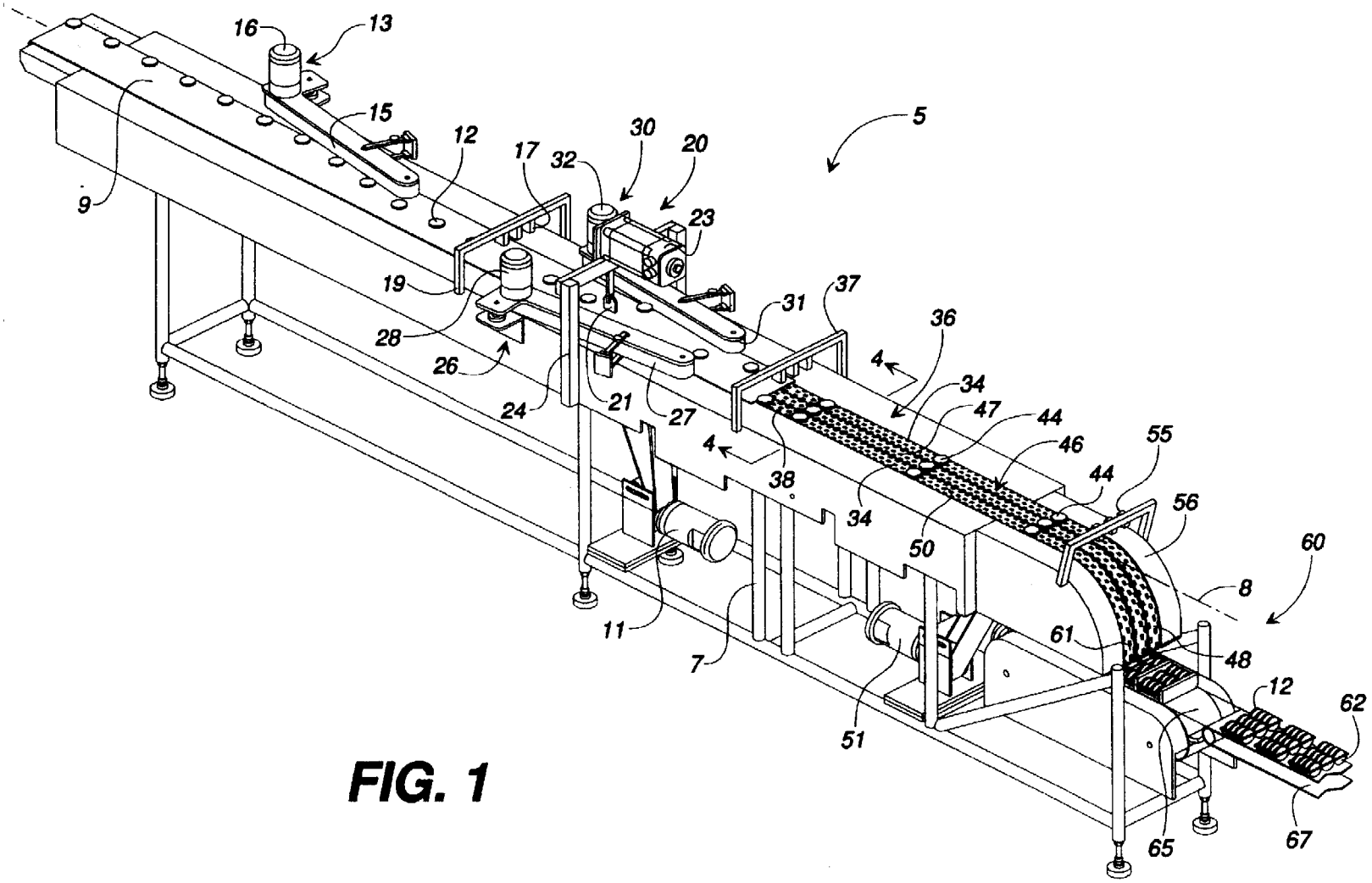
FIG. 1 is a perspective view of a preferred embodiment of the cookie tray loading machine of this invention.
Figure 2:
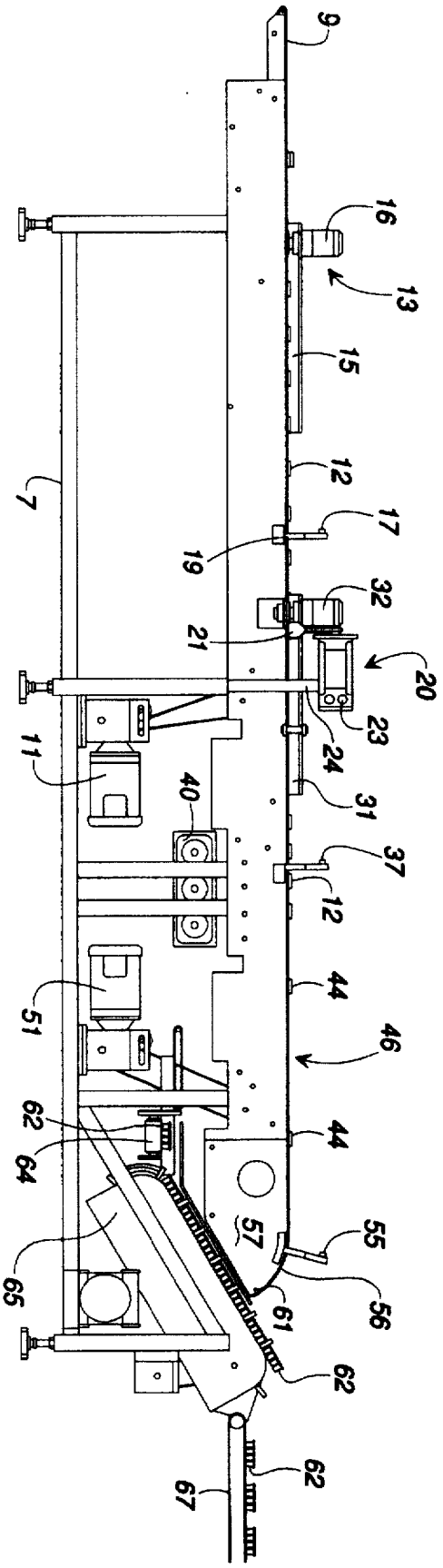
FIG. 2 is a side elevational view of an alternate embodiment of the cookie tray loading machine of FIG. 1.

Referring now in detail to the drawings in which like reference numerals indicate like parts throughout the several views, numeral 5 of FIGS. 1–4 illustrate a preferred embodiment of a cookie tray loading machine. Referring now to FIGS. 1 and 2, loading machine 5 includes a framework 7 having a longitudinal centerline 8 extending along the length of the loading machine. The loading machine is constructed and arranged to receive cookies from a cookie production machine 10, shown schematically in FIG. 3.

Cookies 12 are supplied to loading machine 5 on an elongated infeed conveyor belt 9, the infeed conveyor belt being supplied with a single file lane of cookies from cookie production machine 10. The cookie production machine moves approximately fifteen cookies at a time on a chain conveyor (not illustrated) laterally away from the production machine 10 and toward infeed conveyor belt 9. Infeed conveyor belt 9 is conventionally supported for movement on framework 7. As shown in FIG. 2, infeed conveyor belt 9 is powered by its own servomotor 11.

Figure 3:
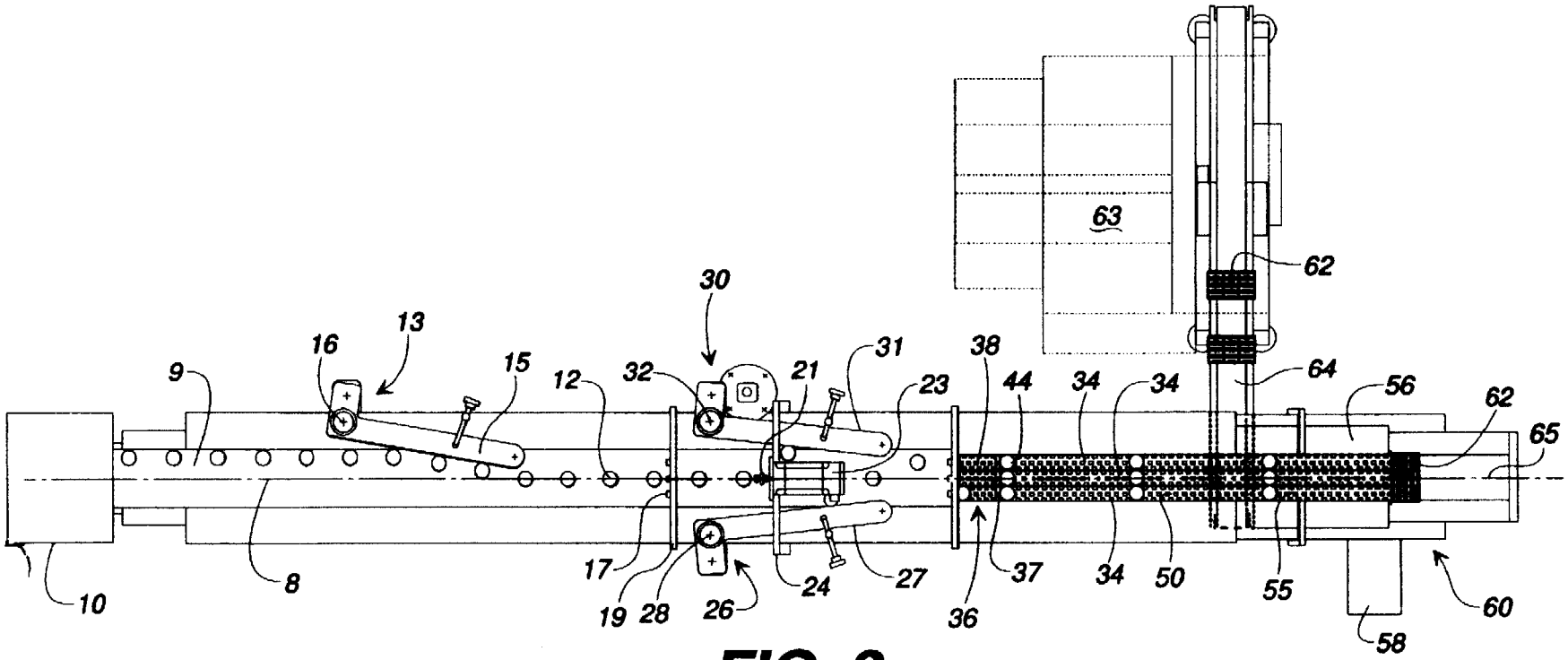
FIG. 3 is a top plan view of the cookie tray loading machine of FIG. 1.
Figure 4:
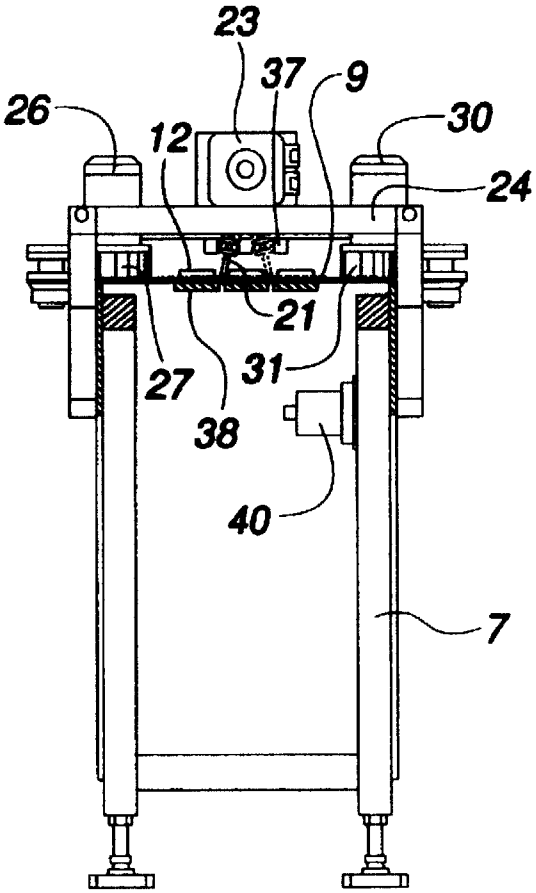
FIG. 4 is a partially detailed cross section view along line 4—4 of FIG. 1.

As best shown in FIG. 3, cookies 12 being fed onto loading machine 5 need not necessarily be aligned along centerline 8 as they are received by the loading machine from the depinning machine. However, as cookies 12 proceed along infeed conveyor belt 9 they are aligned along the longitudinal centerline 8 of framework 7 by infeed alignment arm assembly 13. Longitudinal centerline 8 thus also doubles as the longitudinal axis along which the single file lane of cookies 12 proceed, once aligned as described below.

Infeed alignment arm assembly 13 includes an infeed alignment conveyor belt 15, which may be a conventional flat conveyor belt or a tubing conveyor belt, for example, which is oriented perpendicularly with respect to the surface of infeed conveyor belt 9. The infeed alignment arm assembly also incudes an infeed conveyor belt drive 16 for powering the infeed alignment conveyor belt. Infeed alignment conveyor belt 15 is moved at the same surface velocity as is infeed conveyor belt 9, so that cookies 12 are not rotated or spun on infeed conveyor belt 9 against the infeed alignment arm assembly as they are guided toward and along longitudinal centerline 8 of the framework, which is also the longitudinal centerline of infeed conveyor belt 9.

Figure 10:
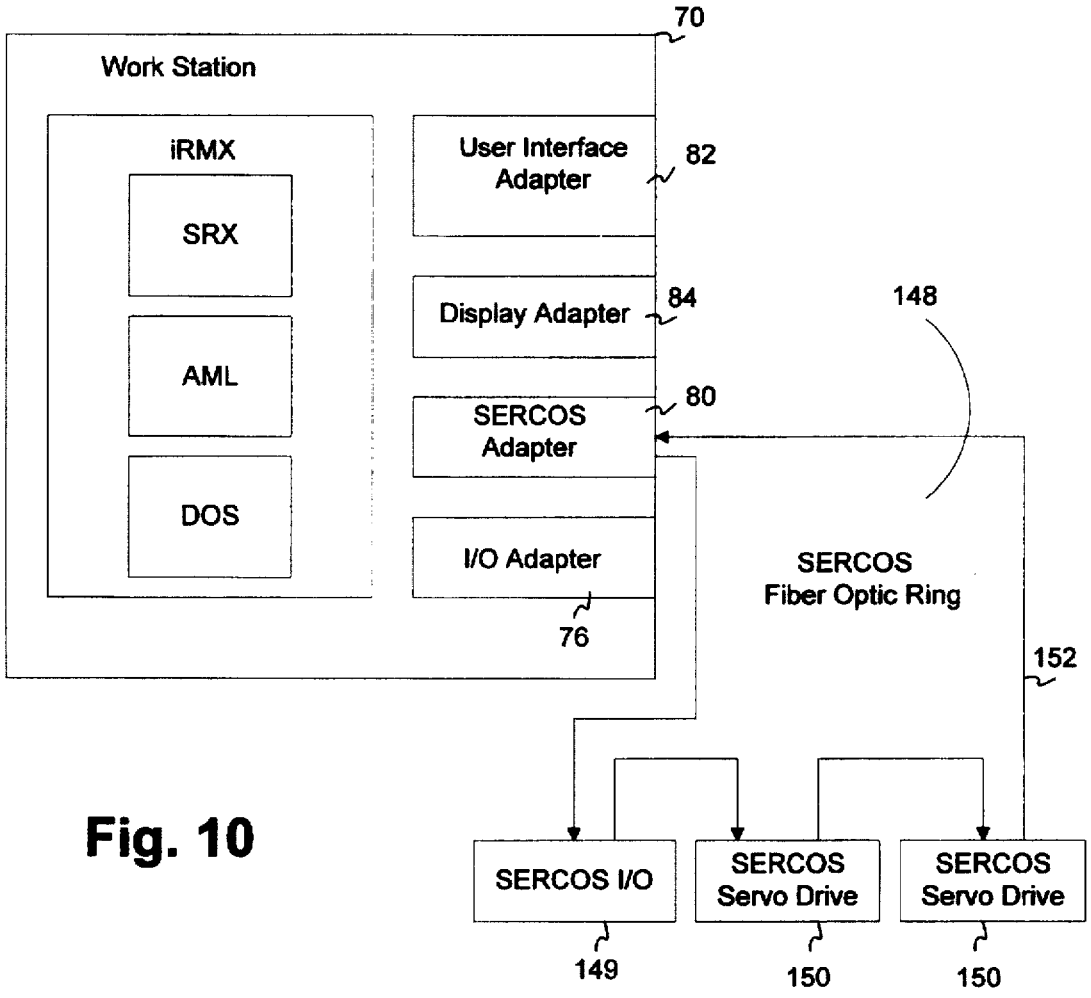
FIG. 10 is a schematic illustration of a computer and a SERCOS fiber optic ring used to control the cookie tray loading machine of FIG. 1.
Figure 11:
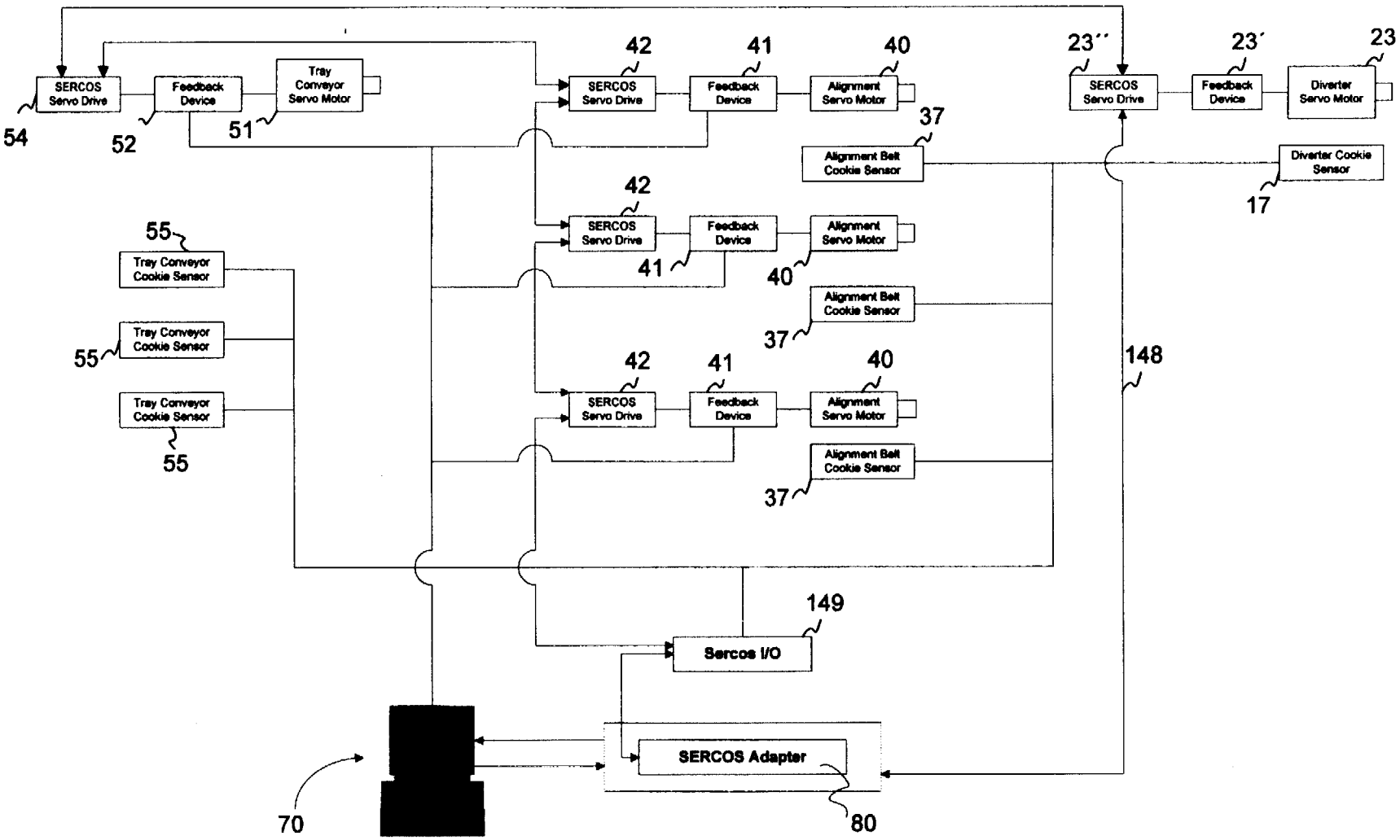
FIG. 11 is a schematic illustration of the SERCOS fiber optic control ring and feedback system used with the computer of FIG. 10 to control the cookie tray loading machine of FIG. 1.

After cookies 12 are aligned along the centerline of infeed conveyor belt 9, they are moved toward and underneath a detector 17, as illustrated in FIGS. 1 and 2. Detector 17 is a photocell detector constructed and arranged to detect, and signal, the presence of the leading edge and trailing edge of each of cookies 12 as they pass thereunder toward diverter assembly 20. Detector 17 is supported above the centerline 8 of infeed conveyor 9 on a support frame 19, as shown in FIGS. 1 and 2. The signal from detector 17 is emitted to a SERCOS I/O board 149, formed as a part of computer 70, all of which is illustrated in FIGS. 10 and 11, and is discussed in greater detail below. The signals from detector 17 are processed in computer 70, whereupon a signal is then sent to diverter assembly 20 moving sweep arm diverter 21 in response thereto.

Referring now to FIGS. 1–3, positioned on framework 7 downstream of detector 17 is diverter assembly 20. Diverter assembly 20 is also positioned above the centerline 8 of infeed conveyor belt 9. Diverter assembly 20 includes a sweep arm diverter 21 attached to a direct drive sweep arm servomotor 23. The diverter assembly is supported on sweep arm support frame 24 above and along centerline 8 of infeed conveyor belt 9.

Sweep arm diverter 21 is directly attached to the shaft of sweep arm servomotor 23, and is directly driven without any reducing gearing or a transmission. It is intended that when sweep arm diverter 21 is in its rest position that it will be angled at approximately 30 degrees from vertical with respect to the surface of infeed conveyor belt 9, and in particular centerline 8 thereof. When actuated, sweep arm diverter 21 will be moved through a 60 degree arc (not illustrated) from rest position to rest position. Thus constructed, sweep arm diverter 21 is constructed to move one of every three cookies 12 to the right of centerline 8, one of every three cookies 12 to the left of centerline 8, and allow one of every three cookies 12 to pass along centerline 8 toward alignment belt assemblies 36. Should sweep arm diverter be out of phase with the cookies being diverted to each respective lane 34 of cookies, the sweep arm diverter can be rotated, i.e., moved through a 360 degree arc, back into its proper rest position so that it is once again oriented 30 degrees from vertical to either the right or left of centerline 8, as required by the order of cookies being diverted.

When signaled by computer 70 (FIG. 11), sweep arm servomotor 23 is actuated for a period of approximately 40 milliseconds. Due to the fact that sweep arm diverter 21 is directly driven there is no gear lash or momentum buildup, and thus sweep arm diverter 21 quickly, but gently, bats or moves cookies 12 to the right and left of centerline 8, as desired. Thus, the single-file lane of cookies 12 fed along infeed conveyor 9 is diverted into three separate lanes 34 of cookies 12, one lane 34 formed to the right of centerline 8, one lane 34 aligned along centerline 8, and one lane 34 formed to the left of centerline 8.

Referring now to FIGS. 1 and 3, as cookies 12 are diverted into one of the three lanes 34, the cookies will be received against either first alignment arm assembly 26, or second lane alignment arm assembly 30, respectively. Alignment arm assemblies 26 and 30 are mirror images of each other, and are positioned to the right and left of the centerline 8 of the infeed conveyor belt 9 at that portion of loading machine 5 on which diverter assembly 20 is supported. This is best shown in FIG. 3.

First alignment arm assembly 26 includes a lane alignment conveyor belt 27, which again can either be a conventional flat conveyor belt or a tubing conveyor belt. Conveyor belt 27 is powered by lane alignment conveyor belt drive 28 so that lane alignment conveyor belt 27 is moved at the same surface speed as infeed conveyor belt 9. In similar fashion, second lane alignment arm assembly 30 includes a lane alignment belt 31, again either a flat conveyor belt or a tubing conveyor belt, moved by a lane alignment conveyor belt drive 32 so that conveyor belt 31 moves at the same surface speed as infeed conveyor belt 9.

First lane alignment arm assembly 26 and second lane alignment assembly 30 are provided to form lanes 34 in conjunction with diverter assembly 20. As every third cookie 12 is moved either to the right or left along infeed conveyor belt 9, the cookie will be pushed against either lane alignment conveyor belt 27 or lane alignment conveyor belt 31, respectively. These two conveyor belts will align cookies 12 into one of lanes 34 so that three generally parallel lanes 34 of cookies 12 are formed at the end of infeed conveyor belt 9 which is moving toward three generally identical alignment belt assemblies 36, one for each lane 34 of cookies 12.

Infeed conveyor belt drive 11, infeed alignment arm conveyor belt drive 16, as well as lane alignment conveyor belt drives 28 and 32 are separately controlled servomotors. However, it is anticipated that conventional electric motors can be used in lieu of these servomotors, as all that is required is that infeed conveyor belt 9, infeed alignment conveyor belt 15, and lane alignment conveyor belts 27 and 31 be moving at the same surface speed with respect to one another so as not to impart a rotating or spinning motion to any one of cookies 12 as they are moved along infeed conveyor belt 9.

Infeed alignment conveyor belt 9 is a conventional conveyor belt, which will have a smooth exterior transport surface, finished with teflon, for example, or an otherwise impervious surface which will allow cookies 12 to be slid easily across the surface thereof without spinning the cookie or depositing any of the chocolate formed on the outside of cookies 12 on the surface of the infeed conveyor belt. It is possible that some chocolate from cookies 12 may adhere to portions of infeed conveyor belt 9, however it is anticipated with the construction discussed hereinabove that the amounts of chocolate deposited on the surface of infeed conveyor belt 9 will be minimal, and will thus not interfere with alignment operations of the cookies. Moreover, although not illustrated specifically herein, it is anticipated that a wiper blade, arm, or assembly could be provided as a part of loading machine 5, and positioned on framework 7 underneath infeed conveyor belt 9 so that the exterior or transport surface of infeed conveyor belt 9 is wiped prior to receiving cookies 12 thereon. Similarly, infeed alignment conveyor belt 15, and lane alignment belts 27 and 31 will also be smooth surface conveyor belts, or tubing belts, which will finished with a non-stick surface, for example, teflon.

Framework 7 is conventionally constructed. It is anticipated that framework 7 will be constructed of stainless steel or any other suitable material providing a smooth, polished surfaced which can be easily cleaned in conjunction with food processing and preparation requirements, and in accordance with the appropriate state and federal food machinery regulations.

Referring now to FIGS. 1 through 3, three identical alignment belt assemblies 36 are disclosed. Each alignment belt assembly 36 includes an alignment belt cookie sensor 37 positioned either below (not illustrated) or above the centerline of each of lanes 34 of cookies as they are passed one each from lanes 34 formed on infeed conveyor belt 9 onto each one of three separate alignment belts 38. Each alignment belt 38 is approximately 4 inches in length, and is a smooth-surfaced belt constructed in fashion similar to infeed conveyor belt 9, so that it has a plastic-coated or non-stick surface to again include, for example, teflon.

Each of alignment belts 38 is independently driven by its own servomotor 40, as shown in FIG. 2. Referring now briefly to FIG. 11, each servomotor 40 includes a feedback device 41, and a servomotor drive controller 42, each of the feedback devices 41 emitting a signal to computer 70, and each of servomotor drive controllers 42 being tied into a SERCOS fiber optic network 148, illustrated in FIG. 11, all of which is described in greater detail below.

Returning now to FIGS. 1 and 3, alignment belt assemblies 36 form the cookies 12 in each of lanes 34 into a generally aligned row 44 of cookies formed laterally across the lanes 34 of cookies, each row 44 of cookies being spaced apart, i.e. phased, from the other so that the rows 44 of cookies can proceed along tray loading conveyor belt 46 toward tray loading station 60, and from there passed directly into one of cookie trays 62. Each of cookies 12 arriving on infeed conveyor belt 9 from the depinning machine 10 (FIG. 1) is approximately 2 inches in length. As the cookies are first pinned on the chain conveyor (not illustrated) of the cookie manufacturing machine (not illustrated), they are spaced in a row 15 abreast, on 6 inch centers so there is an approximate gap of 4 inches between each one of cookies 12 as it is coated along the cookie production line, i.e., the cookie manufacturing machine (not illustrated), depinned, and moved along infeed conveyor belt 9 toward diverter assembly 20. As described above, each one of cookies 12 is then passed along infeed conveyor belt 9 toward diverter assembly 20, whereupon one of every three cookies is moved by sweep arm diverter 21 to the right or left of centerline 8, or allowed to pass along centerline 8 toward alignment belt assemblies 36. Thus, after cookies 12 are formed into the three separate lanes 34 of cookies 12, a gap of approximately 16 inches, equivalent to 18 inch centers, between cookies 12 in each one of lanes 34 of cookies will exist. This, of course, as concerns loading cookies directly into a cookie tray is unworkable in that too much time will be needed to move each one of cookies 12 along the loading machine 5 and into a cookie tray 62, much less index the cookie tray after each row of cookies is loaded within the cells (not illustrated) of the cookie tray.

Rather, what is desired is to form each of cookies 12 into rows 44 of cookies across the three alignment belt assemblies 36 so that the row of cookies can be moved together onto tray loading conveyor belt 46 as a row, and placed as a row into the cells (not illustrated) defined within cookie tray 62 sized to receive cookies 12. Thus, alignment belt assemblies 36 perform two functions. The first of these functions is to form cookies 12 into rows 44, and the second of these functions to space, or phase, each row 44 apart from the other so that sufficient time is permitted to load each row 44 of cookies 12 into cookie tray 62, and then index cookie tray 62 forward, backward, upward, or downward, as the case may be, after each row of cookies is placed into the tray.

It is anticipated, based on the control methodology described hereinbelow, that each of alignment belt assemblies 36 will form rows 44 of cookies which will be separated by a gap of approximately 6 to 8 inches from the center of the last cookie 12 of a first row 44 of cookies to the center of the first cookie 12 of a second or subsequent row 44 of cookies formed by the alignment belt assemblies 36, as shown generally in FIG. 1. Thus, and as shown in FIG. 1, a plurality of rows 44 of cookies 12 will be spaced approximately six to eight inches apart from one another as they move along tray loading conveyor belt 46 toward tray loading station 60.

Figure 13:
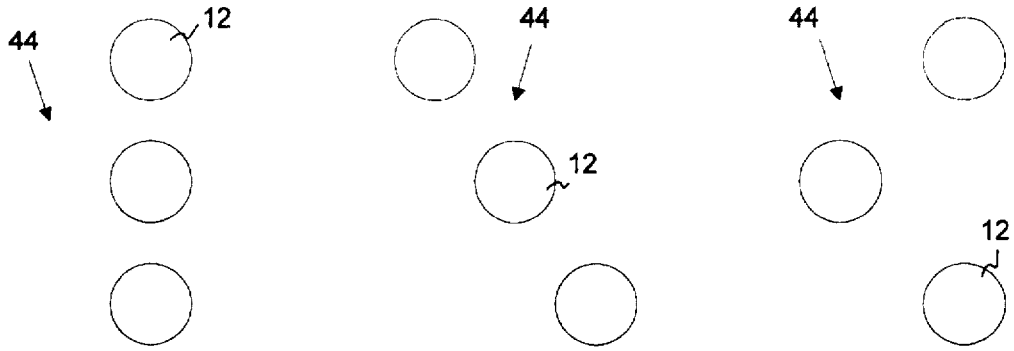
FIGS. 13A, 13B and 13C each illustrate a predetermined pattern of separate rows of cookies formed on the cookie tray loading machine of FIG. 1.

FIGS. 13A, 13B, and 13C schematically represent the predetermined patterns which the rows 44 of cookies can take when aligned on alignment belt assemblies 36. It is anticipated that alignment belt assemblies 36 will form rows 44 of cookies having a predetermined pattern, such as one of those disclosed in FIG. 13A–13C, and that each subsequent row of cookies formed on loading machine 5 will generally have the same predetermined row pattern. This will depend upon the control data entered into the control program executed by computer 70 (FIG. 11) which automatically aligns the cookies on each one of alignment belts 38. A straight row 44 as shown FIG. 13A would be the tightest possible grouping of cookies 12 within any one row of cookies, thus providing the largest gap between the rows of cookies. If, however, the cookies were aligned as shown in FIGS. 13B or 13C, then the gap or distance between each row of cookies would be somewhat smaller from the first cookie of a subsequent row 44 of cookies formed on aligning belts 38 to the last cookie of a previous row 44 of cookies formed thereon and being moved along tray loading conveyor belt 46.

The alignment of cookies 12 into a row 44 of cookies, and the phasing of the rows of cookies apart from one another, involves controlling the speed of at least two of the three cookies 12 within each row of 44 cookies by varying the speed of two out of three alignment belts 38, which is made possible by separately driving each alignment belt 38 with its own servomotor 40. For example, slowing down or stopping the first two alignment belts 38 and allowing the third alignment belt 38 to catch up will form a row of cookies. Another example of forming a row of cookies would be to slow down or stop the first two alignment belts 38 and then speed up the third alignment belt 38 to catch up to the first two cookies to form a row 44 of cookies. All that is required is that the row of cookies be formed into a "row" as such, i.e., a generally aligned group of cookies laterally across the separate lanes 34 of cookies, each row then being spaced apart from one another prior to being placed onto tray loading conveyor belt 46.

One of the goals of alignment belt assemblies 36, and the control methodology practiced by this invention, is to introduce a desired gap between sets, i.e., rows, of product, here cookies, so that enough time is permitted to allow the cookies to settle into the tray 62 of cookies, and for the tray to be indexed in order to receive the next row of cookies. All of this is done, however, without using any kind of physical barrier, such as a pair of spaced fingers as disclosed in U.S. Pat. No. 5,303,811 to Haley, issued Apr. 19, 1994, or without using any other kind of physical barrier or gate to restrain the cookies on a moving conveyor belt to thus form the cookies into a row, and release them. This mechanism, and the method for its control, thus allows far greater flexibility in aligning cookies, and minimizes any damage to the cookies or the deposit of product residue on the loading machine.

Although not illustrated in greater detail herein, it is anticipated that each one of alignment belts 38 will be formed with a generally concave shape in order to better receive each one of cookies 12. Each one of cookies 12, again not illustrated in greater detail here, will have a generally arcuate, i.e., convex, exterior top surface which is riding on the surface of infeed conveyor belt 9, and in turn on each one of alignment belts 38. The top surface of each of cookies 12 rides on the conveyor belts of the loading machine because the cookies are pinned through their bottoms, and are depinned with their top surfaces resting on the conveyor belt and their bottom surfaces facing upward to leave any cookie residue facing upward and away from the loading machine's conveyor belts.

By forming each one of alignment belts 38 in a generally concave fashion, greater control of each one of cookies 12 is provided. In similar fashion, and again not illustrated in greater detail here, each lane of tray loading conveyor belt 46 may also have a generally concave surface, again for more positive control over each one of cookies 12. However, and as described in greater detail below, tray loading conveyor belt 46 is also constructed to hold cookies 12 in position thereon through the use of a plurality of air passageway openings 50 defined in infeed conveyor belt 9 in cooperation with a vacuum chamber 57, and vacuum pump 58, to positively control the cookies 12 as they are moved into cookie tray 62.

Thus, another goal of the alignment belt assemblies 36 and the control methodology practiced by this invention is to receive a single file lane of cookies 12 and place each cookie directly into its respective cell (not illustrated) within cookie tray 62. The use of sweep arm diverter 21 and alignment belt assemblies 36 is much gentler than other alignment methods because it avoids head-on contact with the product as with a gate or fingers, which would lead to jams, and tends to minimize all other contact which may lead to deposition of product residue on the machine.

After rows 44 of cookies 12 are formed on alignment belt assemblies 36, each row 44 of cookies is moved together onto tray loading conveyor belt 46, illustrated in FIGS. 1 and 3. Referring to FIG. 1, tray loading belt 46 has a first end 47 and a spaced second end 48. Tray loading conveyor belt 46 is formed of the same material as is infeed conveyor belt 9 and alignment belts 38, with the exception that tray loading conveyor belt 46 has a plurality of air passageway openings 50 defined therein and extending therethrough. Tray loading conveyor belt 46 may be one conveyor belt, or three narrower, separate, and parallel conveyor belts, all of which are driven together by servomotor 51 illustrated in FIG. 2. As shown in FIG. 11, servomotor 51 also has a feedback device 52, and a servomotor drive controller 54 formed as a part of the conveyor drive.

Returning now to FIGS. 1 and 2, three tray loading conveyor cookie sensors 55, one for each lane 34 of cookies 12, is positioned toward the second end 48 of the conveyor belt. Each of tray loading conveyor sensors 55 can be positioned above the centerline of each lane 34 of cookies, as shown, or alone conveyor belt 46 intermediate first end 47 and second end 48 facing upward (not illustrated) through one of the air passageway openings 50 for detecting the presence of a row of cookies passing overhead toward tray loading station 60 positioned at second end 48 of the conveyor belt.

As the cookies move along the tray loading conveyor belt, they pass over an arcuate portion 56 of the conveyor belt formed at the second end thereof, and into one of cookie trays 62. Thus, and as shown in FIGS. 1 and 2, tray loading conveyor belt 46 has at its second end 48 an arcuate portion 56 which defines a vacuum chamber 57 therein. A conventional vacuum pump 58 is provided as a means to create an air vacuum within chamber 57 by drawing air through the plurality of air passageway openings 50 in tray loading conveyor belt 46 as it passes over the upper portion of the vacuum chamber. The vacuum created by the airflow out of vacuum chamber 57 tends to hold each one of cookies 12, in each row 44 of cookies, in position on tray loading conveyor belt 46 as they pass over the arcuate portion of the conveyor belt and into one of cookie trays 62. This allows for more positive control over the product, and also allows for more precise product placement within a packaging tray.

As shown in FIGS. 1–3, a tray loading station 60 is positioned at second end 48 of the tray loading conveyor belt. Also positioned at the second end 48 of tray loading conveyor belt 46 is a plurality of air jets 61 (FIGS. 1 and 2), in this instance three, one for each lane 34 of cookies, constructed and arranged to direct a jet or stream of compressed air at each one of cookies 12 as they are passed off of tray loading conveyor 46 and into cookie tray 62. Air jets 61 pass only enough air to direct the cookies toward their cells (not illustrated) within the tray, without being forceful enough to blow the cookies out of alignment with the cookie tray which would necessitate physical handling of the cookies.

Each one of cookie trays 62 is de-nested from a conventional tray de-nester 63, as shown in FIG. 3. Thereafter, the cookie trays are moved by tray feed conveyor 64 into position on a tray indexing conveyor 65 formed as a part of tray loading station 60. Tray indexing conveyor 65 is constructed and arranged to index or move cookie tray 62 one row of cookies at a time for receiving cookies from second end 48 of tray loading conveyor belt 46. Although tray indexing conveyor 65 is shown in FIGS. 1–3 as moving cookie tray 62 in a forward direction, it is anticipated that cookie tray 62 can be moved backwards, and that tray indexing conveyor 65 could also be positioned at an angle with respect to second end 48 of the tray loading conveyor so that the tray indexing conveyor would index cookie trays 62 either upward or downward as each row of cookies is placed into one of the cookie trays.

As constructed, second end 48 of tray loading conveyor belt 46 is generally perpendicular to the plane in which each one of cookie trays 62 is moved along tray indexing conveyor 65. Thus, and although arcuate portion 56 is shown in FIG. I is shown as extending through an arc of approximately 90 degrees, it is entirely possible, and anticipated, that any combination of an arcuate portion 56 of loading machine 5 coupled with an angled orientation of tray indexing conveyor 65 is possible so long as second end 48 is generally perpendicular to cookie trays 62 positioned on tray indexing conveyor 65. Thus, and as shown in FIG. 2, an alternate embodiment of tray loading machine 5 could include tray indexing conveyor 65 angled from horizontal with respect to the plane of infeed conveyor belt 9, but yet be oriented at a 90 degree angle to second end 48 of the tray loading conveyor so that cookie trays 62 are generally perpendicular to the second end of the tray loading conveyor belt. This is desired in order to ensure that each one of cookies 12 is directly placed into its provided cell (not illustrated) within each cookie tray 62.

Once each tray 62 of cookies is loaded, it is moved along tray indexing conveyor 65 toward a take away conveyor 67, which moves the filled trays of cookies toward a check weigh system (not illustrated), and a packaging machine (not illustrated) for enclosing the tray in either a box or flexible packaging film.

As with the infeed and lane alignment conveyor belts of tray loading machine 5, respectively, tray feed conveyor 64, tray indexing conveyor 65, and take away conveyor 67 are all powered by separate servomotors (not illustrated) which will be tied into the SERCOS fiber optic control ring 148.

As discussed above, this invention provides an automated, i.e., computer controlled, method of diverting, aligning, phasing, and loading rows 44 of cookies 12 within cookie tray 62. Thus, and as shown in FIG. 5, a computer, shown schematically as numeral 70, is provided for the control of the loading machine.

Figure 5:
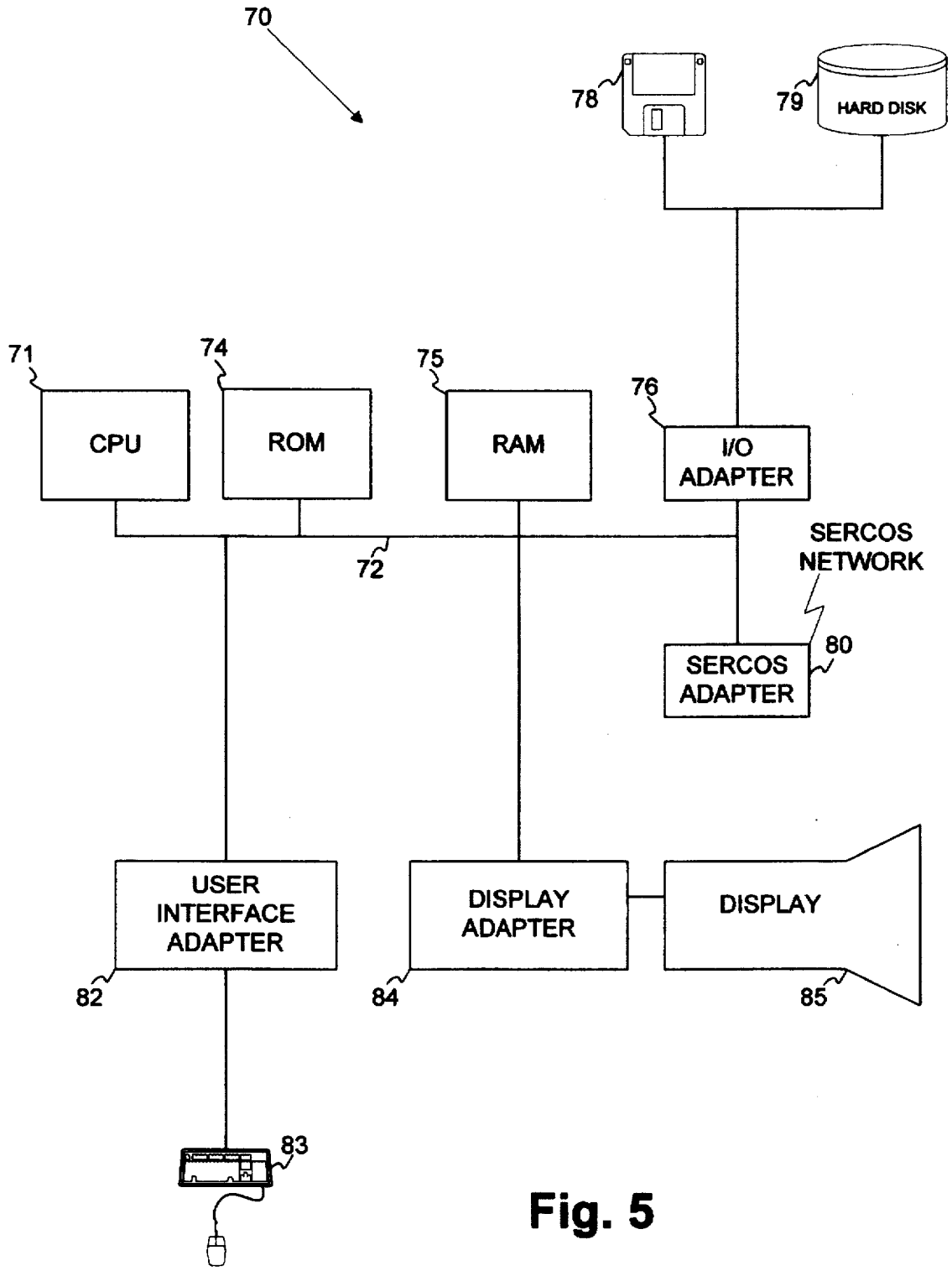
FIG. 5 is a schematic illustration of the computer used to control the cookie tray loading machine of FIG. 1.

Turning now to FIG. 5, computer 70 includes a central processing unit ("CPU") 71. Here it is anticipated that CPU 71 will be an IBM compatible 46DX2/66 megahertz processor with an Industry Standard Architecture ("ISA") data bus 72. Data bus 72 communicates with a read only memory ("ROM") 74, a random access memory ("RAM"), an input/output ("I/O") adaptor 76, a SERCOS interface board/adaptor 80, a user interface adaptor 82, through which keyboard 83 is used for data entry and program control, and a display adaptor 84. Display adaptor 84 provides a signal to separately provided video display 85. Input/output adaptor 76 communicates with either a floppy disk drive 78, or a hard disk drive 79 for the storage and retrieval of program data.

Referring now to FIG. 10, computer 70 is once again shown in schematic fashion. Again, computer 70 has a SERCOS (Serial Real-time Communications Standard) interface board/adaptor 80, plus user interface adaptor 82, and a display adaptor 84. The operating system used to run real-time applications on computer 70 is iRMX. This is shown schematically in FIG. 10. SRX is an extension of the iRMX operating system that run digital servo drives, such as those illustrated in FIGS. 1–4 and in FIG. 11, under the SERCOS standard. The digital servo drives are networked with SERCOS adaptor 80 and a SERCOS compatible input/output card 149. The SERCOS network is cabled with fiber optic cabling 152 connected to each SERCOS device.

The control program utilized in this invention is the AML® motion control language developed by Pacific Scientific Company of Newport Beach, Calif. AML® is a computer software program designed for use with motion control systems. AML® uses a multi-tasking operating system, here iRMX, and SERCOS for multi-tasking control of event-driven and object-oriented applications. As known to those in the art, AML® OBJECTS each have a collection of attributes and operations that are referred to using a single name. Associated with each OBJECT are data members and methods. Data members define the characteristics of the OBJECT, whereas methods are the operations that can be performed on the OBJECT, thus defining the OBJECT's behavior. The AML® modules that make up the AML® motion control application are coded to respond to various events that occur either within the software, or externally to the application. Examples of AML® modules adapted for use with the SERCOS system illustrated in FIGS. 5 and 11 are the Pacific Scientific SC320 series servocontrollers and C750 series servocontrollers, each of which contains a SERCOS personality module (SPM) which is customized to the application/operations in which both the SERCOS modules and AML® language are used.

The AML® motion control language provides an EVENT OBJECT to handle EVENTs as they occur in the motion control system. An EVENT is defined as either an internal or external change of which the application becomes aware. External EVENTs, for example, are physical events that occur in the process being controlled. Internal events are changes that occur in the application, such as software timer lapsing, for example, the firing of a programmable limit switch ("PLS").

In contrast with software polling, wherein a computer continuously examines the system for events, which is the standard used in the art, the AML® motion control language is an EVENT handling process in which the computer waits for an EVENT to occur without constantly processing data. EVENTs are retrieved from an EVENT que using the EVENT OBJECT's wait method. The program, i.e. computer 70, waits and awakens when the EVENT occurs, whereupon the computer starts to service the EVENT. An EVENTID is assigned to distinguish between multiple EVENTs through notification methods associated with the defined AML® objects. Examples of EVENTIDs would be a TIMER object which would issue a NotifyFireAs method to assign an EVENTID when the software timer elapses; with a PLS object for issuing a NotifyFireAs method to assign an EVENTID when the PLS fires; and an I/O OBJECT for issuing a NotifyChangeAs method to assign an EVENTID when I/O point changes state. Thus, EVENT OBJECTs are used to wait for their own set of EVENTIDS. Simply put, an EVENT OBJECT waits for EVENTs unlike programming systems used in the prior art, which are constantly polling sensors and motors for data. Thus, an EVENT does not occur until it is generated by objects that have notification methods. A notification method allows associating an EVENTID with an EVENT that is generated by that object. EVENTIDs are what the EVENT OBJECTs use to distinguish the multitude of EVENTs so that the appropriate actions can be taken in response to each EVENT.

Figure 6:
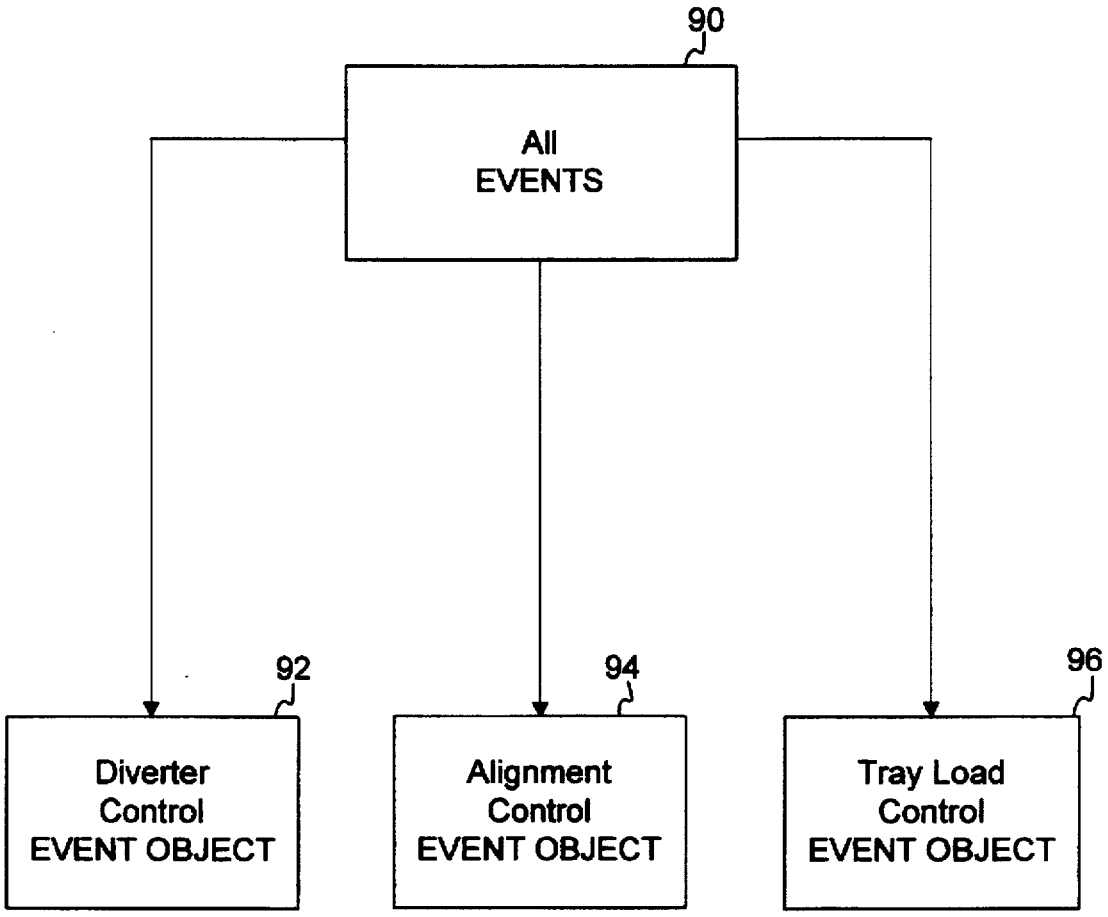
FIG. 6 is a flow chart of the object oriented control methodology used in this invention.

Referring now to FIGS. 6–9, the AML® program controlling loading machine 5 can be implemented with just a single EVENT OBJECT if so desired. Here, however, multiple EVENT OBJECTs are used in the separate stages of loading machine 5 operations for the sake of clarity. Turning first to FIG. 6, step 90 refers to all EVENTs which occur, either externally or internally, in the control of loading machine 5. These EVENTs are executed by the program stored within computer 70 (FIG. 5). Here there are three main EVENT OBJECTs associated with the control of loading machine 5. The first of these is diverter control EVENT OBJECT 92, which is used to wait for EVENTIDs associated with the arrival of product IDs, cookies to be diverted into designated locations, the designated locations being any one of the three alignment belts 38. An EVENT is generated when a cookie is in position for the sweep arm diverter 21 to push the cookie into either the right or left lane 34 of product, or allowing the cookie to pass through diverter assembly 20 and onto the lane 34 of cookies aligned with centerline 8 of the machine, whereupon the sweep arm diverter is not moved to divert the cookie.

Next, an alignment control EVENT OBJECT 94 is shown, the alignment control EVENT OBJECT being used to wait for EVENTIDs associated with the arrival of cookies one each on each one of alignment belts 38, so that alignment control of the cookies can begin to form a row 44 of cookies on the alignment belts, and for spacing each row 44 of cookies apart from each other row 44 of cookies placed onto tray loading conveyor belt 46.

Lastly, a tray load control EVENT OBJECT 96 is illustrated in FIG. 6, this object is used to wait for EVENTIDs associated with the movement of each row of cookies toward cookie tray 62, so that the cookie tray can be indexed by tray indexing conveyor 65 for the next row 44 of cookies to be placed therein before the next row of cookies arrives at tray loading station 60.

Figure 7:
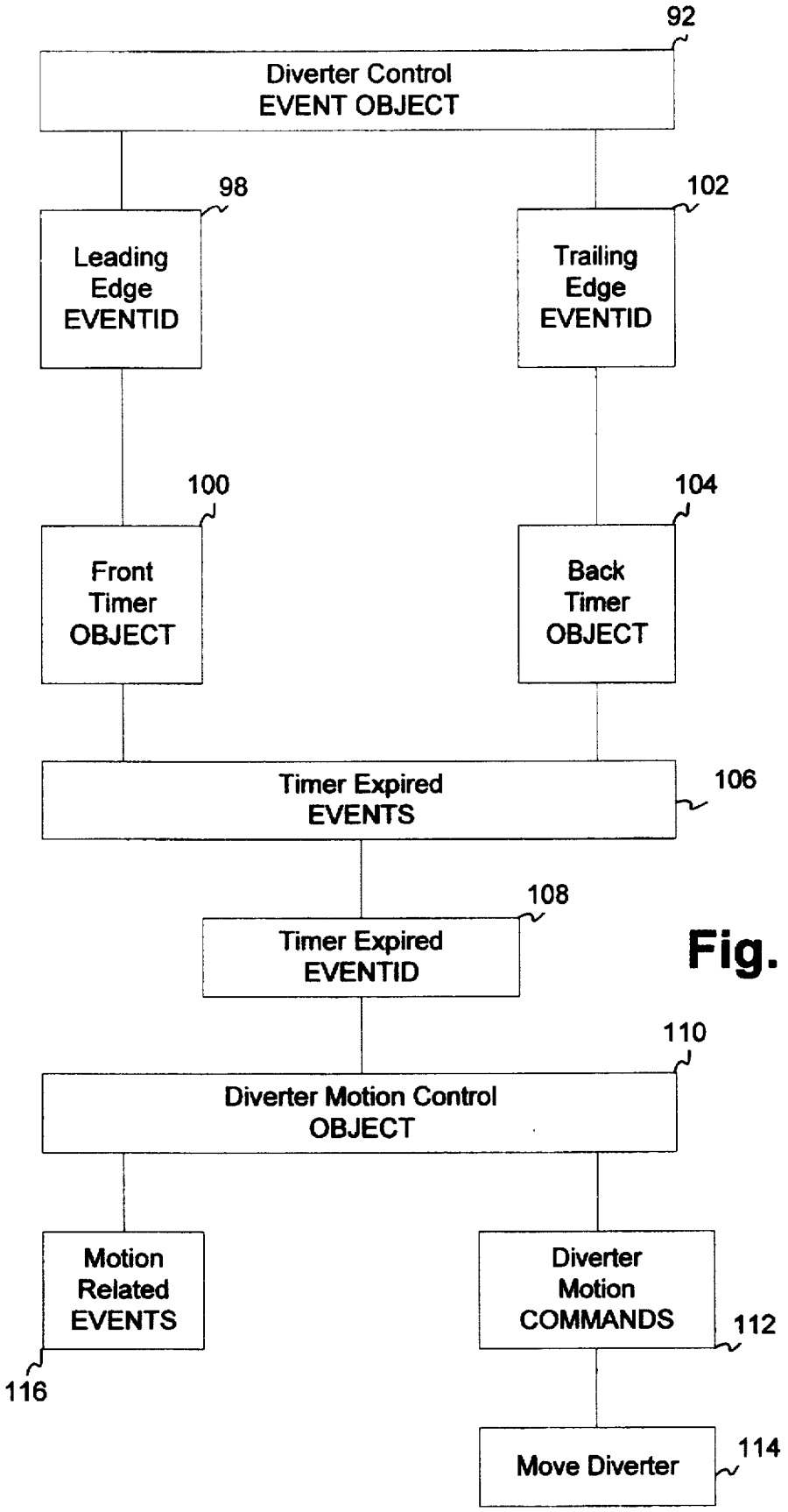
FIG. 7 is a flow chart of the diverter object control system.

Referring now to FIG. 7, diverter control EVENT OBJECT 92 is illustrated in greater detail. There are two EVENTIDs associated with diverter control EVENT OBJECT 92. These are leading edge EVENTID 98 and trailing edge EVENTID 102. These EVENTIDs are generated by the signal emitted from photocell detector 17 as it detects the leading and trailing edges of each cookie 12 moved along infeed conveyor belt 9. Thus, and after generating the leading edge and trailing edge EVENTIDs, an associated front timer OBJECT 100 and an associated back timer OBJECT 104 are each generated, respectively. Thereafter, in accordance with the operation of the AML® program, each one of the timer objects leads to the establishment of timer expired EVENTs 106, which in turn generate a timer-expired EVENTID 108 for signaling diverter motion control OBJECT 110. Once diverter motion control OBJECT 110 is signaled, diverter motion COMMANDS 112 are generated by computer 70 to sweep arm servomotor 23, whereupon sweep arm diverter 21 is moved in step 114. Simultaneously, diverter motion control OBJECT 110 signals motion-related EVENTs 116 which are sensed by computer 70 as the sweep arm diverter is being moved either to the right, left, or placed in a wait state to allow a cookie 12 to pass along the centerline 8 of the conveyor belt toward the middle one of alignment belt assemblies 36.

Figure 8:
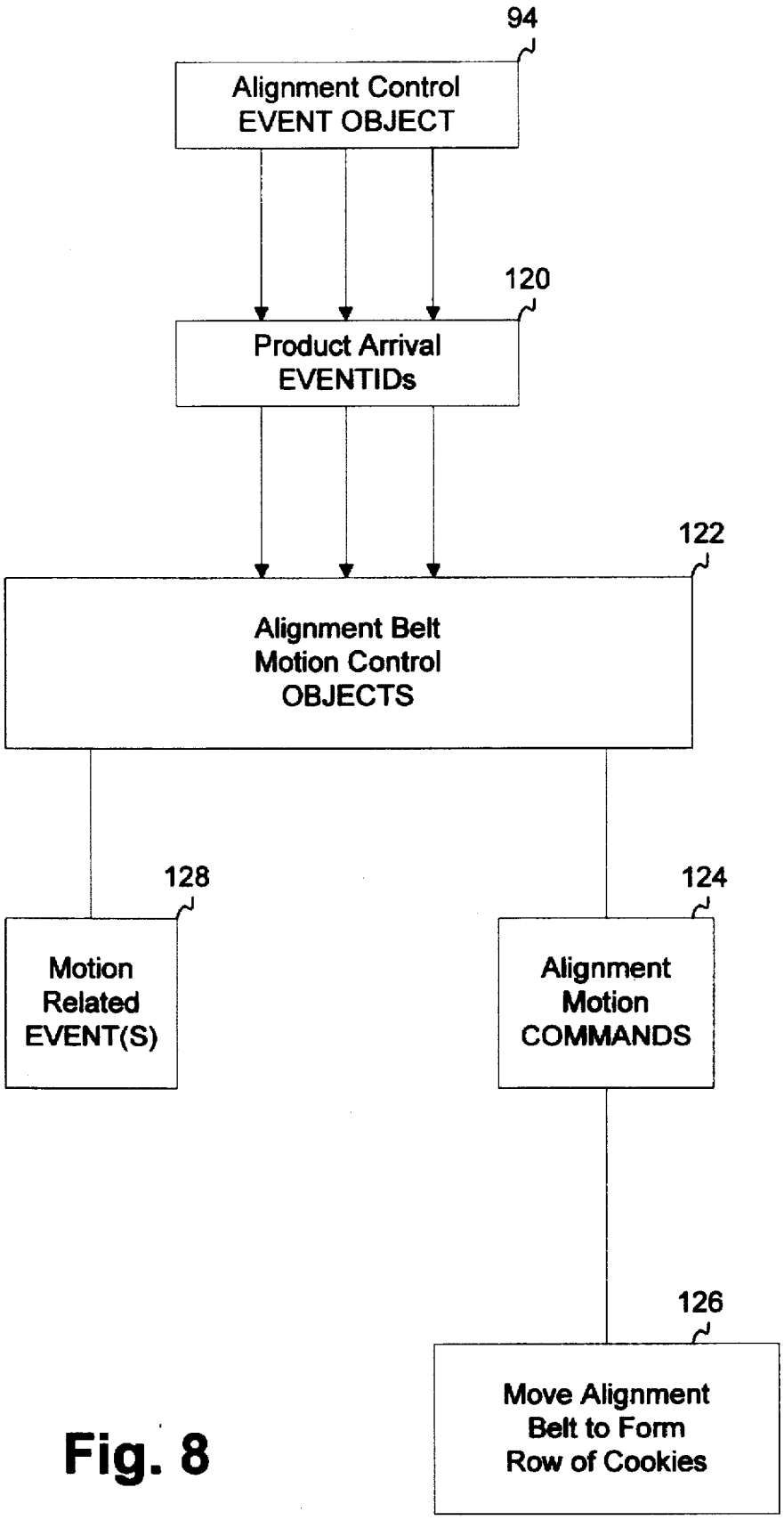
FIG. 8 is a flow chart of the alignment object control system.

Alignment control EVENT OBJECT 94 is illustrated in greater detail in FIG. 8. As shown in FIGS. 1 and 2, and schematically in FIG. 11, once one each of cookies 12 is detected by alignment belt cookie sensors 37, a product arrival EVENTID 120 is generated for each lane 34 of cookies. Thereafter, the alignment belt motion control OBJECTs 122, having waited for the arrival of EVENTIDs, are signaled wherein alignment motion COMMANDS 124 are signaled to each one of alignment belt servomotors 40. Simultaneously, the position of each alignment belt 38, and the position of each cookie 12 placed thereon, is determined by reading the data signaled by alignment belt feedback device 41 for each one of servomotors 40. This information is then signaled to computer 70, processed, and signaled back to servo motor drive controller 42 for each one of servomotors 40 to form rows 44 of cookies on alignment belts 38 having a predetermined pattern, for example the row patterns of FIGS. 13A–13C. Again, and as described above, this can involve stopping two of the three alignment belts 38 while waiting for the last cookie to arrive on the third belt, or by varying, i.e., slowing, the speeds of some belts while waiting for another cookie to be sped up on its alignment belt to catch up to the relative position of the other cookies to form one of the predetermined patterns of rows 44 of cookies shown in FIGS. 13A through 13C.

Thereafter, once the computer has determined that a row 44 of cookies having a predetermined pattern of cookies has been formed, the alignment belts 38 are operated together and at the same speed to move the completed row of cookies onto tray loading conveyor belt 46. This is shown schematically by the move alignment belt to form row of cookies command in step 126, and by the motion-related EVENT in step 128, whereupon the formation of a row of cookies is determined and sensed by each one of feedback devices 41 and servomotor drive controllers 42 in conjunction with computer 70.

Figure 9:
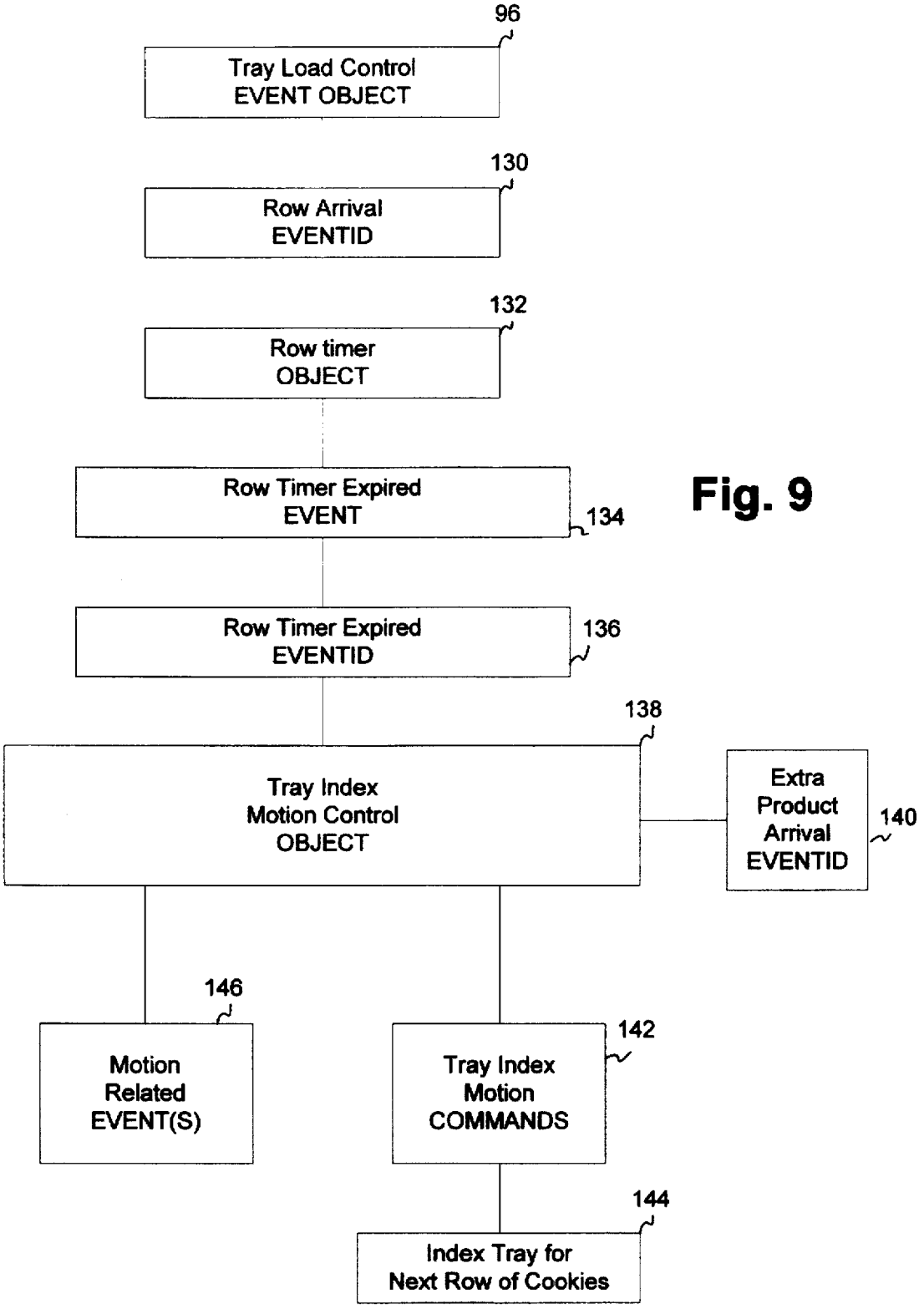
FIG. 9 is a flow chart of the tray load control object system.

The third function performed by the AML® control program is the tray load control EVENT OBJECT 96 illustrated in FIG. 9. Once a row 44 of cookies has been transferred to tray loading conveyor belt 46, and this row of cookies is sensed or detected by tray loading conveyor cookie sensors 55, row arrival EVENTID 130 is signaled. Thereafter, a row timer OBJECT 132 is signaled, for example setting a PLS within the software program to await the passage of a predetermined amount of time, at which point a row timer expired EVENT 134 is signaled resulting in a row timer expired EVENTID 136, which in turn signals tray index motion control OBJECT 138 for indexing cookie tray 62 on indexing conveyor 65.

Still referring to FIG. 9, extra cookies may arrive at cookie tray 62, although not otherwise expected, resulting in an extra product arrival EVENTID 140. EVENTID 140 would be generated by tray loading conveyor cookies sensors 55 detecting the passage of an out of position or out of place cookie not formed as part of a row of cookies, a "rouge" cookie as it were, thus necessitating the indexing of the tray so as to prevent a subsequent row of cookies from being placed on top of the extra product. Thus, if extra product is detected, an extra product arrival EVENTID 140 is signaled to tray index motion control OBJECT 138. In either instance, either row timer expired EVENTID 136, or extra product arrival EVENTID 140, tray index motion control OBJECT 138 signals tray index motion COMMANDS 142 to the servomotor (not illustrated) which indexes tray indexing conveyor 65, as shown in step 144. Simultaneously therewith, motion related EVENTs 146 are signaled by the feedback device (not illustrated) associated with the servomotor for the tray indexing conveyor, thus letting computer 70 know that all operations are proceeding as programmed.

Although front and back timer OBJECTS 100 and 104 are illustrated in FIG. 7, and row timer OBJECT 132 is illustrated in FIG. 9, it is possible that rather than using a timer OBJECT a PLS, programmable limit switch OBJECT, could be assigned to each cookie. A PLS OBJECT would keep track of the position of the cookie based on the activity of the servomotor, as signaled through feedback device 23' for sweep arm servomotor 23, and feedback device 52 for tray loading conveyor belt servomotor 51, to computer 70. A timer OBJECT would keep track of the amount of time that had lapsed since the cookie was detected. When using the timer OBJECT to keep track of the position of the cookie, it is assumed that the servomotors are driving the conveyor belts at a constant speed. Thus, if the servomotors change the speed of the conveyor belts, respectively, then the timer object will have to be adjusted for this change. A PLS OBJECT, on the other hand, works off of the encoders, i.e. feedback devices, associated with each servomotor, so that the position of the servomotor, and thus the conveyor belt, is precisely maintained and determined. Either one of these OBJECTS, either a timer object, or a PLS OBJECT, could be used interchangeably to generate an EVENT to signal when a cookie is in its desired location.

Thus, the use of the AML® control programming language in this invention can best be summarized by capsulizing the operation of loading machine 5 as follows. Computer 70 waits for a first notification that each cookie 12 is moving along infeed conveyor belt 9, and that each cookie has been detected by photocell detector 17. This would be the detection of the leading edge of each cookie 12. Computer 70 then waits for a second notification that each cookie 12 has been moved along the empty conveyor belt 9 to a desired location, i.e. the trailing edge of the cookie has been detected. Thereafter, the computer assigns a corresponding OBJECT to each cookie, the OBJECT representing the motion of the cookie and generating a third notification that the cookie is in a desired location, i.e. underneath or positioned in line with sweep arm diverter 21 for movement either to the right or left of center line 8 of the loading machine. Thereafter, the computer signals sweep arm servomotor 23 for two out of every three cookies to move cookie 12 either to the right or left of center line 8 of the machine. This is done on a time delay basis, as shown in FIG. 7, wherein a timer expired EVENTID 108 is used to signal diverter motion control OBJECT 110.

Thereafter, computer 70 waits for a fourth notification from alignment belt cookie sensors 37 that a cookie has arrived at each one of alignment belt assemblies 36, and onto each one of alignment belts 38. Thereafter, the motion of each one of alignment belts 38 is controlled with respect to one another for forming cookies 12 thereon into a first generally aligned row 44 of cookies in a predetermined pattern (FIGS. 13A–13C), and moving the complete row 44 of product together onto tray loading conveyor belt 46 in response thereto. Thereafter, computer 70 waits for a fifth notification from tray loading conveyor cookie sensors 55 that the first row 44 of cookies has been moved along the tray loading conveyor belt 46 toward tray loading station 60, it being assumed that the cookies will pass into cookie tray 62 positioned in the tray loading station. Accordingly, in response to the fifth notification received by the computer, the computer signals the servomotor which drives tray indexing conveyor 65, and cookie tray 62 is indexed a distance equal to the space one row of cookies will take within the tray. This process is continually repeated until all cookies have been aligned into rows, and passed toward and placed into cookie trays 62.

The SERCOS fiber optic ring 48 in the control system utilized to operate loading machine 5 is illustrated in FIGS. 10 and 11. Turning first to FIG. 10, computer 70 is shown with its SERCOS adapter 80, formed as a part of SERCOS fiber optic ring 148. The SERCOS fiber optic ring includes a SERCOS input/output module 149, and a number of SERCOS servomotor drive controllers 150, schematically shown as being linked to one another by fiber optic cabling 152.

Referring now to FIG. 11, the servomotor drive control components of loading machine 5 are illustrated in conjunction with computer 70. SERCOS adapter 80 is in communication with data bus 72 of computer 70, and with SERCOS input/output module 149 which is cabled in serial with the SERCOS adapter, as well as each of the SERCOS servomotor drive controllers to form SERCOS fiber optic ring 148. The SERCOS fiber optic ring includes the sweep arm diverter servomotor drive controller 23", the tray loading conveyor belt servomotor drive controller 54, each one of the three alignment belt servomotor drive controllers 42, SERCOS input/output module 149, and SERCOS adapter 80. In addition, although not directly tied into the SERCOS fiber optic ring 140, photocell detector 17, each one of alignment belt cookie sensors 37, and each one of tray loading conveyor loading cookie sensors 55 are wired into SERCOS input/output module 149. In conventional fashion, each one of alignment belt feedback devices 41 and tray loading conveyor belt feedback device 52 signal CPU 71 of computer 70, which in turn issues commands to SERCOS adapter 80 for execution by the SERCOS fiber optic ring/network in conjunction with the execution of the control program illustrated in FIGS. 6–9 and described above. Thus, CPU 71 receives data signals from each one of the appropriate feedback devices, and from the appropriate sensors, either directly through the SERCOS fiber optic ring, i.e., or indirectly through SERCOS input/output module 149 and SERCOS adapter 80, to execute the control program which automatically diverts a single file lane of cookies 12 moved along centerline 8 of infeed conveyor belt 9 to one of three separate lanes 34 of cookies 12, forming each group of cookies 12 on alignment belt assemblies 36 into a row 44 of cookies having a predetermined pattern, moving each row 44 of cookies onto tray loading conveyor belt 46, and then moving each row of cookies to tray loading station 60 for placement directly into one of cookie trays 62 without any manual control, or undue physical handling of cookies 12, thus ensuring greater reliability and operational speed, while minimizing product damage and loss in packaging chocolate covered cake-type cookies efficiently and economically.

Each one of the servomotors, feedback devices and servomotor drive controllers used in the preferred embodiment of the invention is conventional, and can be obtained from any one of a number of suppliers, to include, for example, those components manufactured and supplied by the Motor and Control Division of Pacific Scientific located in Rockford, Ill.

OPERATION

Figure 12A:
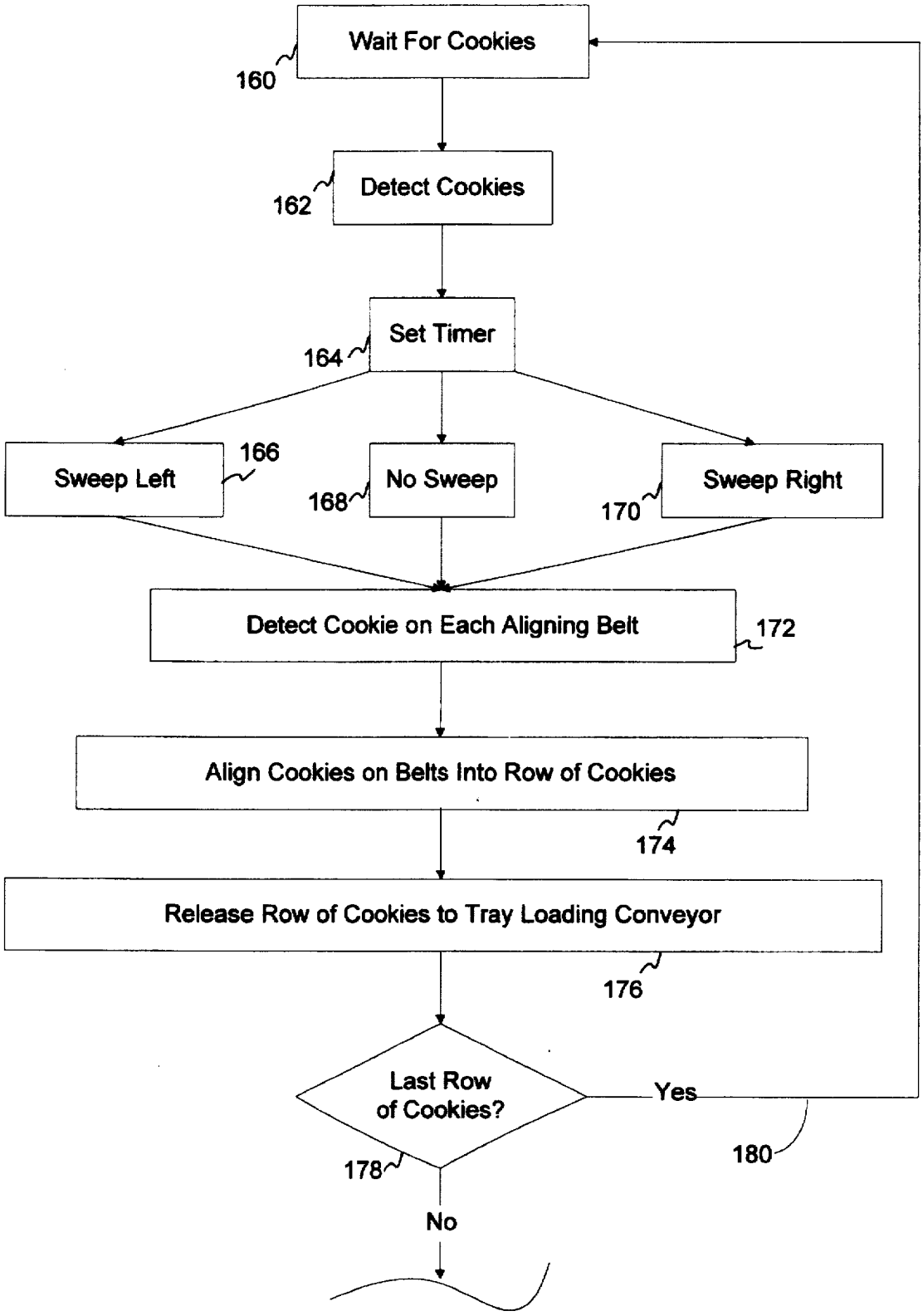
FIGS. 12A and 12B are a composite flow chart of the operations performed by the cookie tray loading machine.
Figure 12B:
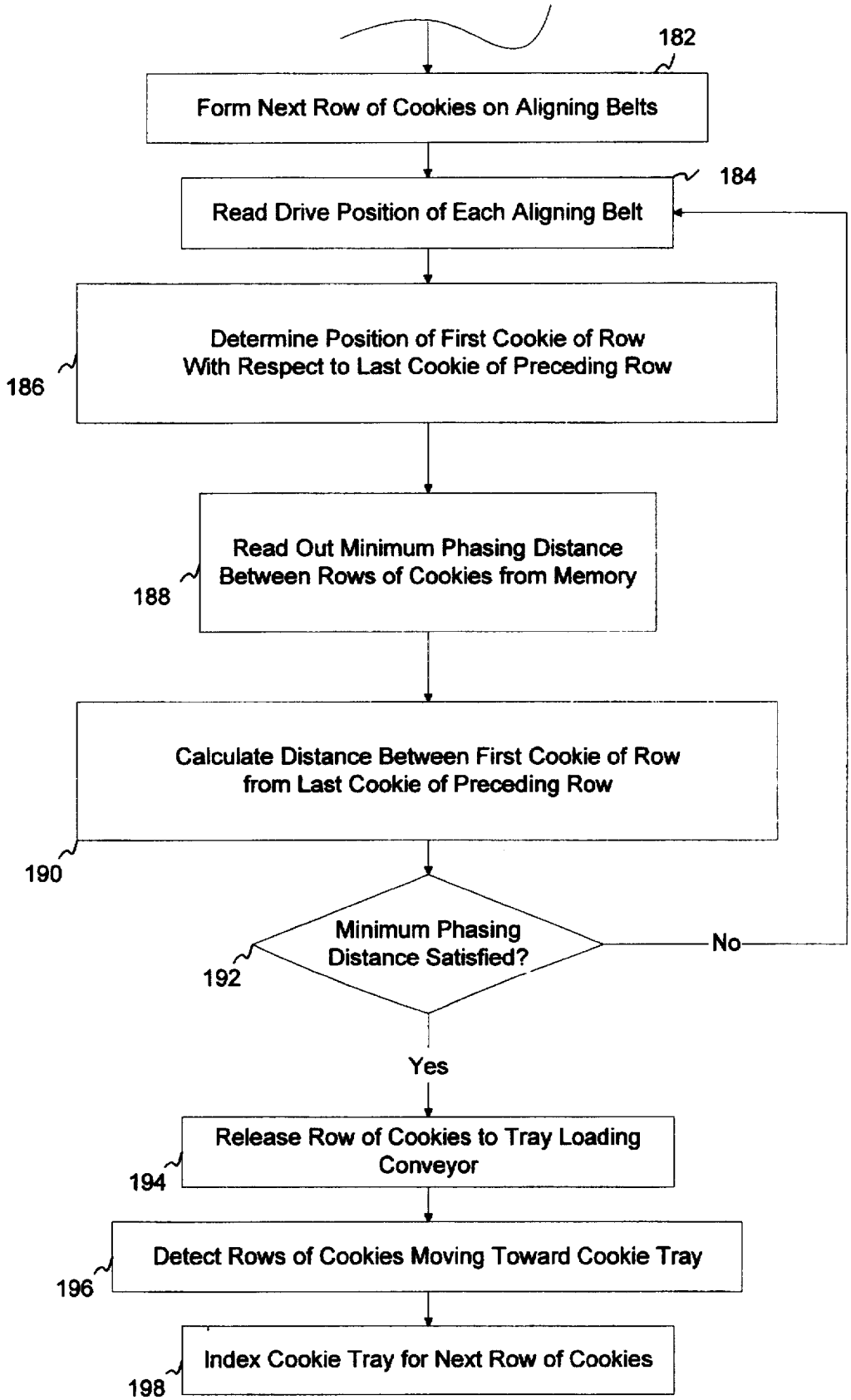

A flow chart detailing the operations performed by loading machine 5 is illustrated in FIGS. 12A and 12B.

Turning first to FIG. 12A, in step 160, computer 70 is waiting for the notification that cookies have arrived at photocell detector 17. Thereafter, in step 162 cookies are detected, whereupon the front timer OBJECT 100 and back timer OBJECT 104 (FIG. 7) are set in step 164. Thereafter, and in conjunction with the program executed by computer 70, sweep arm diverter 21 either sweeps left in step 166, does not sweep, thus permitting the cookie to pass along centerline line 8 beyond diverter assembly 20 in step 168, or sweeps right in step 170.

The next step in the machine's operation is to detect a cookie 12 on each alignment belt 38 through alignment belt cookie sensors 37 in step 172. Once this is done, the cookies are aligned into rows 44 of cookies on the alignment belts in step 174. The row of cookies is then moved together and released to the tray loading conveyor in step 176, whereupon the computer determines whether this is the last row of cookies processed. If this is the last row of cookies, i.e., no more cookies have been detected, the computer executes step 180 and loops back to step 160, waiting for cookies. If this is not the last row of cookies, however, then the program proceeds to step 182 shown in FIG. 12B, wherein the next row 44 of cookies is formed on alignment belts 38. Thereafter, while phasing the subsequent row of cookies positioned on alignment belts 38 from the first row of cookies moving down tray loading conveyor belt 46, the computer will read the drive position of each alignment belt 38 in step 184 by reading the data emitted from feedback devices 41 for each one of alignment belt assemblies 36, and for feedback device 52 of tray loading conveyor belt 46, to determine in step 186 the position of the first cookie of the row of cookies on the alignment belts with respect to the last cookie of the preceding row of cookies moving down the tray loading conveyor belt. The computer will then poll its memory in step 188 to read out the minimum phasing distance, previously set by the machine operator, and then in step 190 will calculate the distance between the first cookie in the row of cookies on alignment belts 38 from the last cookie of the preceding row 44 of cookies on tray loading conveyor belt 46 in step 190. Thereafter, in step 192, the computer determines whether the minimum phasing distance set by the operator, and read out of memory in step 188, has been satisfied. If not, the program loops back to step 184 and repeats the process until a positive answer is obtained. Once a positive answer is obtained, the computer executes step 194 wherein the row of cookies held on the alignment belt 38 is released to tray loading conveyor 46 in step 194, the row of cookies being detected in step 196 by tray loading conveyor cookie sensors 55 as it is moving toward cookie tray 62, and then indexing cookie tray 62 in step 198 to receive the next row 44 of cookies therein.

Thus, the invention disclosed herein provides an improved method and apparatus for processing chocolate-covered cake-type cookies, as well as any and all similar types of foodstuffs, by taking a single file infeed lane of articles of product, diverting them into separate and generally parallel lanes of product, aligning the product into lateral rows across the lanes of products, phasing or spacing the rows of product apart from each other, and moving the rows of product along a tray loading conveyor for placement directly into a packaging tray.

While a preferred embodiment of the invention has been disclosed in the foregoing specification, it is understood by those skilled in the art that variations and modifications thereof can be made without departing from the spirit and scope of the invention, as set forth in the following claims. Moreover, the corresponding structures, materials, acts, and equivalents of all means or steps plus function elements in the claimed elements are intended to include any structure, material, or acts for performing the functions in combination with other claimed elements as specifically claimed.

We claim:

1. An automated method of loading cookies into a cookie tray on a cookie tray loading machine, the loading machine being supplied with a single file lane of cookies being carried on an infeed conveyor belt moving toward a cookie tray loading station, the infeed conveyor belt having a longitudinal centerline, and a cookie tray positioned at the cookie tray loading station, said method comprising the steps of:

a) diverting the single file lane of cookies moving on the infeed conveyor belt into at least two separate lanes of cookies moving toward the cookie tray loading station;

b) forming the cookies within said separate lanes of cookies into a plurality of generally aligned rows of cookies across said separate lanes of cookies;

c) transferring each row of cookies so formed to a tray loading conveyor belt and phasing each respective one of said rows of cookies from each preceding row of cookies as the rows of cookies are transferred onto the conveyor belt so that said rows of cookies are spaced apart from each preceding row of cookies;

d) positioning the cookie tray at the cookie tray loading station with respect to a fixed discharge end of said cookie tray loading conveyor belt;

e) passing each respective row of cookies directly into the cookie tray from the fixed discharge end of the conveyor belt; and f) indexing the cookie tray with respect to the discharge end of the conveyor belt in response to receiving each respective row of cookies therein.

2. The method of claim 1, wherein step a) comprises the steps of detecting the presence of the oncoming cookies being carried on the infeed conveyor belt, and selectively sweeping selected ones of the cookies laterally across the surface of the infeed conveyor belt in response thereto.

3. The method of claim 2, further comprising the steps of:

sweeping one of every three cookies laterally across the infeed conveyor belt toward a first alignment belt positioned to the right of the infeed conveyor centerline;

allowing one of every three cookies to pass along the centerline of the infeed conveyor belt toward a second alignment belt;

sweeping one of every three cookies laterally across the infeed conveyor belt toward a third alignment belt positioned to the left of the infeed conveyor centerline; and forming three discrete and parallel lanes of cookies in response thereto.

4. The method of claim 1, wherein step b) comprises the step of detecting the presence of a cookie on each respective one of a series of spaced, parallel and elongate alignment belts, one each of said alignment belts being provided for each of said at least two lanes of cookies.

5. The method of claim 4, further comprising the step of separately controlling the speed of each of said alignment belts with respect to one another in response to detecting the presence of a cookie on each respective one of said alignment belts.

6. The method of claim 5, wherein the step of controlling the speed of each respective one of said alignment belts comprises the steps of:

signaling a drive position for each respective one of said alignment belts;

determining the position of the first cookie in a row of cookies being formed on said alignment belts with respect to the last cookie in a preceding row of cookies in response thereto; and signaling a drive motor for each said alignment belt, respectively, in response thereto so that each row of cookies is generally spaced from each preceding row of cookies in the range of form 6 to 8 inches.

7. The method of claim 1, wherein step e) comprises the steps of:

moving the cookies along, said conveyor belt over an arcuate portion formed at the discharge end thereof;

creating an air vacuum within a vacuum chamber formed within said arcuate portion; and generally holding the cookies in position on said conveyor belt in response thereto.

8. The method of claim 1, step e) comprising the step of momentarily directing a jet of compressed air at each cookie as it falls off of the discharge end of said cookie tray loading conveyor belt directly into the cookie tray.

9. The method of claim 1, wherein step c) further comprises the step of moving said rows of cookies from an alignment belt assembly having an independently driven alignment belt for each of said at least two separate lanes of cookies, and of varying the speed of each of said alignment belts with respect to one another and forming each of said rows of cookies thereon prior to transferring said row of cookies onto said conveyor belt.

10. A cookie tray loading machine for loading cookies into cookie trays, the tray loading machine including a framework having a longitudinal centerline, an infeed conveyor belt supported on the framework for moving cookies in a single file lane thereon toward a downstream cookie tray loading station at which the cookie trays are positioned, the infeed conveyor belt having a longitudinal centerline, and an infeed alignment arm for aligning the single file lane of cookies thereon, said machine comprising:

means for selectively diverting selected ones of the cookies from the single file lane of cookies across the infeed conveyor belt into at least two separate lanes of cookies moving toward the tray loading station;

means for forming the cookies within said at least two separate lanes of cookies into a series of generally aligned rows of cookies formed laterally across said lanes of cookies;

means for phasing said rows of cookies apart from one another as the rows of cookies move downstream toward the cookie tray loading station; and means for loading said rows of cookies, respectively directly into the cookie trays, said means for loading comprising:

an elongate tray loading conveyor belt fixedly supported on the framework of the machine downstream of the infeed conveyor, said conveyor belt moving toward the cookie tray loading station and onto which the rows of cookies are transferred, and having a discharge end positioned at the cookie tray loading station; and a cookie tray indexing conveyor supported on the framework at the cookie tray loading station with respect to the discharge end of said conveyor belt for carrying empty cookie trays thereon;

wherein said tray loading conveyor belt is constructed and arranged to pass the respective rows of cookies off of the discharge end thereof and directly into the cookie trays;

and wherein said tray indexing conveyor is constructed and arranged to index the cookie trays with respect to the discharge end of said conveyor belt in response to the placement of each separate row of cookies, respectively into the cookie trays.

11. The loading machine of claim 10, wherein said means for diverting the single file lane of cookies comprises an elongate sweep arm supported on said framework and positioned above the single file lane of cookies on the infeed conveyor belt, said sweep arm being constructed and arranged to sweep through a radial arc transversely with respect to the single file lane of cookies and to momentarily strike the selected cookies for diverting the selected cookies from the single file lane of cookies, and a detector constructed and arranged to detect, and to signal, the presence of oncoming cookies with respect to said sweep arm.

12. The loading machine of claim 11, wherein said sweep arm moves at least some of the selected cookies across the surface of the infeed conveyor belt laterally to the right, and laterally to the left, with respect to the single file lane of cookies thereon.

13. The loading machine of claim 11, wherein said detector comprises a photocell detector supported on the framework of the cookie tray loading machine, said detector being positioned above the single file lane of cookies on the infeed conveyor belt upstream of said sweep arm.

14. The loading machine of claim 13, further comprising a computer constructed and arranged to receive the signal emitted by said photocell detector and to control the movement of said sweep arm in response thereto.

15. The loading machine of claim 14, wherein said computer controls the movement of said sweep arm on a time delay basis in response to receiving the signal emitted from said photocell detector.

16. The loading machine of claim 10, wherein said means for forming rows of cookies comprises a separate alignment belt for each one of said at least two separate lanes of cookies, each said alignment belt being supported on the framework of the cookie tray loading machine intermediate the infeed conveyor belt and said tray loading conveyor belt and being sized and shaped to receive cookies thereon from the infeed conveyor.

17. The loading machine of claim 16, further comprising means for detecting and signaling the presence of cookies delivered from the infeed conveyor belt to each of said alignment belts.

18. The loading machine of claim 17, wherein said alignment belts are constructed and arranged to be driven independently of, and with respect to, each other.

19. The loading machine of claim 18, further comprising a computer constructed and arranged to receive the signals emitted by said means for detection and signaling, wherein said computer is constructed and arranged to control the speed of said alignment belts in response thereto and forms a row of cookies on said alignment belts across said at least two lanes of cookies.

20. The loading machine of claim 18, further comprising:

a separate servomotor for each said alignment belt, each said servomotor being constructed to drive its respective alignment belt independently of the other ones of said alignment belts, each said servomotor including a feedback device formed as a part of the servomotor for signaling the drive position thereof;

wherein said means for phasing comprises a computer, said computer being constructed and arranged to receive and process the signals emitted from each said feedback device, respectively, and from said means for detecting and signaling the presence of cookies delivered to the respective ones of said alignment belts, for determining the position of the first cookie in one of said rows of cookies with respect to the last cookie in a preceding row of cookies;

wherein each respective one of said servomotors is signaled by said computer to drive said alignment belts independently of one another to form the rows of cookies, and so that each row of cookies is generally spaced apart from each preceding row of cookies.

21. The loading machine of claim 20, wherein each of said rows of cookies, respectively, is spaced apart from each preceding row of cookies in the range of from six to eight inches.

22. The loading machine of claim 10, said means for loading the cookies directly into the cookie trays further comprising:

a plurality of air passageway openings defined within said tray loading conveyor belt and passing therethrough;

wherein the discharge end of said conveyor belt includes an arcuate portion extending downwardly toward the cookie tray loading station;

a vacuum chamber defined beneath at least a part of said arcuate portion of said conveyor belt; and means for creating an air vacuum within said vacuum chamber, wherein air is drawn through said openings defined in said conveyor belt and into the vacuum chamber for generally holding the cookies in position on said conveyor belt.

23. The loading machine of claim of claim 22, wherein the discharge end of said tray loading conveyor belt is positioned adjacent and spaced from the cookie trays positioned on the cookie tray indexing conveyor at the tray loading station and defines a gap therebetween, and an air jet positioned with respect to said gap to selectively emit a directional compressed air flow for directing the cookies into the cookie trays and away from the discharge end of said conveyor belt.

24. A cookie tray loading machine, the machine including a framework having a longitudinal centerline, an infeed conveyor supported on the framework and carrying a series of spaced cookies in a single file lane thereon toward a downstream cookie tray loading station formed as a part of the machine, and a plurality of cookie trays at the cookie tray loading station, the infeed conveyor having a longitudinal centerline and an infeed alignment arm for aligning the cookies along the infeed conveyor, said machine comprising:

a sweep arm diverter constructed and arranged to selectively divert selected ones of the cookies from the single file lane of cookies into at least two separate and generally parallel lanes of cookies, said sweep arm diverter being supported on the framework of the machine above and spaced from the single file lane of cookies on the infeed conveyor belt;

a detector positioned on the framework with respect to said diverter for detecting the passage of cookies moving toward said diverter;

the diverter having an elongate sweep arm constructed and arranged to be swept through an arc transversely with respect to the single file lane of cookies in response to the detection of the cookies by said detector, and to momentarily strike the selected ones of said cookies for moving the selected ones of the cookies laterally across the infeed conveyor with respect to the single file lane of cookies;

an alignment belt assembly supported on the framework downstream of said diverter constructed and arranged to form the cookies within said at least two separate lanes of cookies into a series of generally aligned rows of cookies formed across said at least two separate lanes of cookies;

means for phasing said rows of cookies so that said rows of cookies so formed are spaced apart from each preceding row of cookies; and means for loading the rows of cookies directly into the cookie trays.

25. The loading machine of claim 24, further comprising:

a computer;

a servomotor;

said sweep arm having a first end fastened to and actuated by said servomotor, and a spaced second end sized and shaped to strike the selected one of the cookies;

wherein said detector comprises a photocell detector constructed and arranged to emit a signal to said computer in response to the detection of a cookie within the single file lane of cookies; and wherein said computer receives said signal from said photocell and controls the movement of said servomotor in accordance with a preprogrammed series of instructions stored within said computer to form said at least two lanes of cookies in response thereto.

26. The loading machine of claim 24, wherein said sweep arm diverter selectively forms three separate lanes of cookies, and wherein said alignment belt assembly includes three of said alignment belts, one for each of said three lanes of cookies, said alignment belts being generally parallel to one another and being sized and shaped to receive the cookies thereon from the infeed conveyor belt.

27. The loading machine of claim 26, further comprising detection means for detecting and signaling the presence of cookies delivered from the infeed conveyor belt to each respective one of said alignment belts.

28. The loading machine of claim 27, wherein each said alignment belt has a drive servomotor, and wherein each of said drive servomotors is constructed and arranged to operate independently of one another.

29. The loading machine of claim 28, further comprising a computer constructed and arranged to receive the signals emitted by said detection means and to signal said servomotors for controlling the drive speed thereof in response thereto.

30. The loading machine of claim 29, wherein:

said means for phasing said rows of cookies comprises a feedback device formed as a part of each of said drive servomotors, each said feedback device being constructed and arranged to emit a signal of the drive position of said respective servomotors to said computer;

wherein said computer determines the position of the first cookie in a row of cookies on said alignment belts with respect to the last cookie in a preceding row of cookies in response to the receipt of the signals by said detection means and said feedback devices, respectively;

and wherein each of said drive servomotors for each of said alignment belts is signaled by said computer to drive said respective alignment belts independently of one another so that each row of cookies is generally spaced apart in the range of from six to eight inches from one another.

31. An apparatus for loading cookies into a cookie tray, comprising:

an infeed conveyor advancing a single file lane of cookies along a path of travel toward a downstream cookie tray;

means for selectively diverting at least some of the cookies of the single file lane of cookies into at least two longitudinally extending lanes of cookies;

means for forming the cookies within said at least two lanes of cookies into generally aligned rows of cookies extending across said at least two lanes of cookies;

said means for forming the cookies into rows of cookies across said at least two lanes of cookies comprising:

an endless alignment belt for each of said at least two lanes of cookies, said alignment belts being parallel to one another and positioned intermediate said infeed conveyor belt and said means for loading the cookies directly into said cookie trays;

each of said alignment belts including a servomotor constructed and arranged to independently drive its respective alignment belt each said servomotor including an encoder constructed and arranged to emit a servomotor drive position signal;

a detector positioned above each said alignment belt, each said detector being constructed and arranged to detect the presence of a cookie on its the respective alignment belt and to emit a detection signal in response to detecting a cookie thereon;

a computer, said computer being constructed and arranged to receive said servomotor drive position signals and said detection signals, and to emit a control signal to each of said servomotors in response thereto to selectively vary the speed of the respective alignment belts independently of one another in accordance with a preprogrammed series of instructions stored within said computer to form a row of cookies on said alignment belts;

means for spacing each row of cookies so formed from each preceding row of cookies so formed; and means for loading the cookies of each of said rows of cookies directly into the cookie trays.

32. The apparatus of claim 31, wherein said means for spacing comprises a preprogrammed series of instructions stored with said computer, wherein said computer is further constructed and arranged to vary the speed of each of said alignment belt assemblies with respect to the speed of said means for loading as each row of cookies is being formed to control the movement of the rows of cookies so formed with respect to, and spaced from, the preceding rows of cookies.

* * * * *